US007753464B2

(12) United States Patent
Sayama et al.

(10) Patent No.: US 7,753,464 B2
(45) Date of Patent: Jul. 13, 2010

(54) LIQUID-JET APPARATUS

(75) Inventors: Tomohiro Sayama, Matsumoto (JP); Toru Nagate, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 786 days.

(21) Appl. No.: 11/616,739

(22) Filed: Dec. 27, 2006

(65) Prior Publication Data

US 2007/0146403 A1 Jun. 28, 2007

(30) Foreign Application Priority Data

Dec. 28, 2005 (JP) ..... 2005-378664

(51) Int. Cl.
*B41J 29/38* (2006.01)

(52) U.S. Cl. ..... 347/10; 347/5; 347/11

(58) Field of Classification Search ..... 347/5, 347/9–12, 14, 15
See application file for complete search history.

(56) References Cited

U.S. PATENT DOCUMENTS 6,416,149 B2 * 7/2002 Takahashi ..... 347/10
2002/0018083 A1 * 2/2002 Sayama ..... 347/5

FOREIGN PATENT DOCUMENTS

| | | |
|---|---|---|
| JP | 2001-121722 | 5/2001 |
| JP | 2001-301206 | 10/2001 |
| JP | 2002-264307 | 9/2002 |

* cited by examiner

*Primary Examiner*—Lam S Nguyen
(74) *Attorney, Agent, or Firm*—Workman Nydegger

(57) ABSTRACT

A liquid-jet apparatus includes: a driving signal generating unit that generates a ejecting driving signal, which is a periodic signal having a plurality of pulse waveforms; a driving pulse generating unit that generates a driving pulse string for each unit region of a medium to be printed upon, on the basis of gray-scale data for the unit region, the ejecting driving signal, and information on whether the driving pulse string generated for a previous unit region includes a last pulse waveform or a pulse waveform immediately before the last pulse waveform in one cycle of the ejecting driving signal; and a control unit that drives the pressure changing unit on the basis of the driving pulse. In the liquid-jet apparatus, the one cycle of the ejecting driving signal corresponds to one unit region of the medium to be printed upon.

7 Claims, 9 Drawing Sheets

LIQUID-JET APPARATUS

The entire disclosure of Japanese Patent Application No. 2005-378664, filed Dec. 28, 2005 is expressly incorporated by reference herein.

BACKGROUND

1. Technical Field

The present invention relates to a liquid-jet apparatus for ejecting liquid droplets from nozzle openings, and more specifically, to a liquid-jet apparatus capable of ejecting liquid droplets from nozzle openings on the basis of driving pulses.

2. Related Art

In ink-jet recording apparatuses (a kind of liquid-jet apparatus), such as ink-jet printers and ink-jet plotters, while a recording head (head member) is moved in the main scanning direction and a recording sheet (a kind of medium to be printed upon) is moved in the sub-scanning direction, ink droplets are discharged from nozzle openings of the recording head, thereby forming images (characters) on the recording sheet. For example, a pressure generating chamber communicating with the nozzle openings is compressed or decompressed to eject the ink droplets.

For example, the deformation of a piezoelectric vibrator is used to compress or decompress the pressure generating chamber. In the recording head, the piezoelectric vibrator is deformed in accordance with a driving pulse supplied. The deformation of the piezoelectric vibrator causes the volume of the pressure chamber to vary, and the variation in the volume of the pressure chamber causes ink droplets to be ejected from the nozzle openings.

In the recording apparatus, a driving signal, which is a periodic signal having pulse waveforms, is generated. Meanwhile, ejecting data (gray-scale data) is transmitted to the recording head. Only necessary pulse waveforms are selected from the driving signal on the basis of the transmitted ejecting data, and the selected pulse waveforms are supplied to the piezoelectric vibrator. That is, the ejecting of the ink droplets from the nozzle openings is controlled by the ejecting data.

When the ink droplets are ejected with the recording head in an off state, the ink droplets drop to positions directly below the nozzle openings. However, in general, the ink droplets are ejected while the recording head is moving in order to print images at high speed. The ink droplets ejected from the recording head while the recording head is moving drop at positions deviating from the positions that are directly below the nozzle openings due to inertia caused by the movement of the recording head.

For example, the inventors have proposed a technique for improving the accuracy of recording in consideration of the deviation between actual and intended ink drop positions (JP-A-2002-264307). In JP-A-2002-264307, the inventors have proposed a technique for adjusting the phase of each driving pulse on the basis of the ejecting speed of ink droplets, which is a measured value obtained corresponding to piezoelectric vibrators of nozzle openings and ink characteristics, in order to markedly improve the accuracy of recording, paying attention to the deviation between actual and intended ink drop positions.

However, the inventors found that the ejecting speed of ink droplets obtained corresponding to the piezoelectric vibrators of the nozzle openings and the ink characteristics varied in accordance with the ejecting state of ink to the previous pixel (the ejecting of ink in a previous printing period). The inventors investigated the cause and came to the following conclusion. That is, after an ink droplet is ejected from the nozzle opening, the meniscus of ink in the nozzle opening having ejected the ink droplet has the vibration state shown in FIG. 10. When pressure to ejecting the next ink droplet is applied with a meniscus formed at the outside of the nozzle opening (a region A in FIG. 10), a large amount of ink droplets is ejected at high speed. In particular, when the meniscus is formed at the outside of the nozzle opening immediately after an ink droplet is ejected and then pressure to ejecting the next ink droplet is applied, a larger amount of ink droplets is ejected at high speed.

In order to avoid this phenomenon, a method of supplying no signal for ejecting ink droplets when a meniscus is formed at the outside of the nozzle opening (the region A in FIG. 10) may be proposed. However, the method makes it difficult to realize a high-speed recording operation. In other words, in order to realize the high-speed recording operation, it is effective to start the next printing period even when the meniscus is formed at the outside of the nozzle opening.

SUMMARY

An advantage of some aspects of the invention is that it provides a liquid-jet apparatus, such as an ink-jet recording apparatus, capable of starting the next printing period while controlling the ejecting speed and amount of ink droplets ejected even when a meniscus is formed at the outside of a nozzle opening having ejected an ink droplet in the previous printing period, thereby achieving a high-speed recording operation.

According to an aspect of the invention, a liquid-jet apparatus includes: a head member that has nozzle openings formed therein; a pressure changing unit that changes the pressure of liquid in the nozzle openings to eject liquid droplets; a medium holding unit that holds a medium to be ejected upon such that the medium to be ejected upon is arranged opposite to the nozzle openings of the head member and is separated from each of the nozzle openings at a substantially equal distance therefrom; a moving mechanism that moves the head member relative to the medium to be printed upon; a driving signal generating unit that generates a ejecting driving signal, which is a periodic signal having a plurality of pulse waveforms; a driving pulse generating unit that generates a driving pulse string for each unit region of the medium to be ejected upon, on the basis of gray-scale data for the unit region, the eject driving signal, and information on whether the driving pulse string generated for a previous unit region includes a last pulse waveform or a pulse waveform immediately before the last pulse waveform in one cycle of the ejecting driving signal; and a control unit that drives the pressure changing unit on the basis of the driving pulse. In the liquid-jet apparatus, the one cycle of the ejecting driving signal corresponds to one unit region of the medium to be printed upon.

According to this aspect, the driving pulse string is generated on the basis of information on whether the driving pulse string generated for the previous unit region (for example, a pixel) includes the last pulse waveform or a pulse waveform immediately before the last pulse waveform in one cycle of the ejecting driving signal. Therefore, it is possible to generate a driving pulse string considering the residual vibration of a liquid meniscus of the nozzle opening having ejected a liquid droplet in response to the last pulse waveform or the pulse waveform immediately before the last pulse waveform.

The residual vibration of the liquid meniscus has a large effect on the ejecting of a liquid droplet having a relatively small size.

For example, in the liquid-jet apparatus according to the above-mentioned aspect, preferably, the gray-scale data includes data for a small dot for forming a small dot on the medium to be ejected upon. In addition, preferably, if the gray-scale data for the unit region is the data for a small dot, at least a first pulse waveform of the driving pulse string generated by the driving pulse generating unit when the driving pulse string generated for the previous unit region includes the last pulse waveform or the pulse waveform immediately before the last pulse waveform in the one cycle of the ejecting driving signal is shifted in terms of time to the latter part of at least a first pulse waveform of the driving pulse string generated by the driving pulse generating unit when the driving pulse string generated for the previous unit region does not include either the last pulse waveform or the pulse waveform immediately before the last pulse waveform in the one cycle of the ejecting driving signal.

The reason is as follows. That is, in the nozzle opening having ejected a liquid droplet in the previous unit region in response to the last pulse waveform or the pulse waveform immediately before the last pulse waveform in one cycle of the ejecting driving signal, the ejecting speed of liquid droplets forming the current unit region may increase due to the residual vibration of the liquid meniscus (which causes the early dropping of ink droplets). Therefore, in order to prevent the early dropping of ink droplets, it is effective to shift at least a first pulse waveform of the driving pulse string for the current unit region to the latter part in terms of time (which delays the drop of ink droplets).

It is considered that the residual vibration of the meniscus of liquid has a larger effect on the ejecting speed of ink droplets as the size of the ink droplet ejected by an ink droplet ejecting operation causing the residual vibration becomes larger.

In the liquid-jet apparatus according to the above-mentioned aspect, preferably, the last pulse waveform in the one cycle of the ejecting driving signal is a pulse waveform for ejecting a relatively small amount of liquid droplets, and the pulse waveform immediately before the last pulse waveform in the one cycle of the ejecting driving signal is a pulse waveform for ejecting a relatively intermediate amount of liquid droplets. The gray-scale data may include the data for a small dot for forming a small dot on the medium to be printed upon. Preferably, if the gray-scale data for the unit region is the data for a small dot, at least the first pulse waveform of the driving pulse string generated by the driving pulse generating unit when the driving pulse string generated for the previous unit region includes the last pulse waveform, but does not include the pulse waveform immediately before the last pulse waveform in the one cycle of the ejecting driving signal is shifted in terms of time to the latter part of at least the first pulse waveform of the driving pulse string generated by the driving pulse generating unit when the driving pulse string generated for the previous unit region does not include either the last pulse waveform or the pulse waveform immediately before the last pulse waveform in the one cycle of the ejecting driving signal. In addition, preferably, at least the first pulse waveform of the driving pulse string generated by the driving pulse generating unit when the driving pulse string generated for the previous unit region includes the pulse waveform immediately before the last pulse waveform in the one cycle of the ejecting driving signal is shifted in terms of time to the latter part of at least the first pulse waveform of the driving pulse string generated by the driving pulse generating unit when the driving pulse string generated for the previous unit region does not include the pulse waveform immediately before the last pulse waveform, but includes the last pulse waveform in the one cycle of the ejecting driving signal.

In the liquid-jet apparatus according to the above-mentioned aspect, preferably, the last pulse waveform in the one cycle of the ejecting driving signal is a pulse waveform for ejecting a relatively intermediate amount of liquid droplets, and the pulse waveform immediately before the last pulse waveform in the one cycle of the ejecting driving signal is a pulse waveform for ejecting a relatively small amount of liquid droplets. The gray-scale data may include the data for a small dot for forming a small dot on the medium to be ejected upon. Preferably, if the gray-scale data for the unit region is the data for a small dot, at least the first pulse waveform of the driving pulse string generated by the driving pulse generating unit when the driving pulse string generated for the previous unit region does not include the last pulse waveform, but includes the pulse waveform immediately before the last pulse waveform in the one cycle of the ejecting driving signal is shifted in terms of time to the latter part of at least the first pulse waveform of the driving pulse string generated by the driving pulse generating unit when the driving pulse string generated for the previous unit region does not include either the last pulse waveform or the pulse waveform immediately before the last pulse waveform in the one cycle of the ejecting driving signal. In addition, preferably, at least the first pulse waveform of the driving pulse string generated by the driving pulse generating unit when the driving pulse string generated for the previous unit region includes the last pulse waveform in the one cycle of the ejecting driving signal is shifted in terms of time to the latter part of at least the first pulse waveform of the driving pulse string generated by the driving pulse generating unit when the driving pulse string generated for the previous unit region does not include the last pulse waveform, but includes the pulse waveform immediately before the last pulse waveform in the one cycle of the ejecting driving signal.

In the liquid-jet apparatus according to the above-mentioned aspect, preferably, the ejecting driving signal is a periodic signal having four first pulse waveforms and a second waveform in one cycle. Preferably, the four first pulse waveforms are arranged in first to third periods and a fifth period in the one cycle, and the second pulse waveform is arranged in a fourth period. Preferably, the first pulse waveform is a pulse waveform for discharging a relatively small amount of liquid droplets, and the second pulse waveform is a pulse waveform for discharging a relatively intermediate amount of liquid droplets.

In the liquid-jet apparatus according to the above-mentioned aspect, preferably, if the gray-scale data for the unit region is the data for a small dot, the driving pulse string generated by the driving pulse generating unit when the driving pulse string generated for the previous unit region does not include the second pulse waveform in the fourth period of the one cycle of the ejecting driving signal, but includes the first pulse waveform in the fifth period is a driving pulse string including the first pulse waveform in the second period of the one cycle, and the driving pulse string generated by the driving pulse generating unit when the driving pulse string generated for the previous unit region includes the second pulse waveform in the fourth period of the one cycle of the ejecting driving signal is a driving pulse string including the first pulse waveform in the third period of the one cycle. In addition, preferably, the driving pulse string generated by the driving pulse generating unit when the driving pulse string generated for the previous unit region does not include either the first pulse waveform in the fifth period of the one cycle of the ejecting driving signal or the second pulse waveform in the fourth period thereof is a driving pulse string including the first pulse waveform in the first period of the one cycle.

The invention can be applied to an embodiment using a plurality of ejecting driving signal COMs.

According to another aspect of the invention, a liquid-jet apparatus includes: a head member that has nozzle openings formed therein; a pressure changing unit that changes the pressure of liquid in the nozzle openings to ejecting liquid droplets; a medium holding unit that holds a medium to be ejected upon such that the medium to be ejected upon is arranged opposite to the nozzle openings of the head member and is separated from each of the nozzle openings at a substantially equal distance therefrom; a moving mechanism that moves the head member relative to the medium to be ejected upon; a driving signal generating unit that generates a first ejecting driving signal and a second ejecting driving signal which are periodic signals having different pulse waveforms but having the same cycle; a driving pulse generating unit that generates a driving pulse string for each unit region of the medium to be ejected upon, on the basis of gray-scale data for the unit region, the first ejecting driving signal, the second ejecting driving signal, information on whether the driving pulse string generated for a previous unit region includes a last pulse waveform in one cycle of the first ejecting driving signal, and information on whether the driving pulse string generated for a previous unit region includes a last pulse waveform in one cycle of the second ejecting driving signal; and a control unit that drives the pressure changing unit on the basis of the driving pulses. In the liquid-jet apparatus, the one cycle of the ejecting driving signals corresponds to one unit region of the medium to be ejected upon. The last pulse waveform in the one cycle of the first ejecting driving signal is a pulse waveform for ejecting a relatively large amount of liquid droplets, and the last pulse waveform in the one cycle of the second ejecting driving signal is a pulse waveform for ejecting a relatively intermediate amount of liquid droplets. The gray-scale data includes data for a large dot for forming a large dot on the medium to be ejected upon. If the gray-scale data for the unit region is the data for a large dot, at least a first pulse waveform of the driving pulse string generated by the driving pulse generating unit when the driving pulse string generated for the previous unit region includes the last pulse waveform in the one cycle of the second ejecting driving signal, but does not include the last pulse waveform in the one cycle of the first ejecting driving signal is shifted in terms of time to the latter part of at least a first pulse waveform of the driving pulse string generated by the driving pulse generating unit when the driving pulse string generated for the previous unit region does not include either the last pulse waveform in the one cycle of the first ejecting driving signal or the last pulse waveform in the one cycle of the second ejecting driving signal. In addition, at least the first pulse waveform of the driving pulse string generated by the driving pulse generating unit when the driving pulse string generated for the previous unit region includes the last pulse waveform in the one cycle of the first ejecting driving signal, but does not include the last pulse waveform in the one cycle of the second ejecting driving signal is shifted in terms of time to the latter part of at least the first pulse waveform of the driving pulse string generated by the driving pulse generating unit when the driving pulse string generated for the previous unit region includes the last pulse waveform in the one cycle of the second ejecting driving signal, but does not include the last pulse waveform in the one cycle of the first ejecting driving signal.

According to the above-mentioned aspect, the driving pulse string is generated on the basis of information on whether the driving pulse string generated for the previous unit region (for example, a pixel) includes the last pulse waveform in one cycle of the first ejecting driving signal or the last pulse waveform in one cycle of the second ejecting driving signal. Therefore, it is possible to generate a driving pulse string considering the residual vibration of a liquid meniscus of the nozzle opening having ejected a liquid droplet in response to the last pulse waveform and the degree of the residual vibration.

According to still another aspect of the invention, there is provided a control device that controls a liquid-jet apparatus including a head member that has nozzle openings formed therein, a pressure changing unit that changes the pressure of liquid in the nozzle openings to ejecting liquid droplets, a medium holding unit that holds a medium to be ejected upon such that the medium to be ejected upon is arranged opposite to the nozzle openings of the head member and is separated from each of the nozzle openings at a substantially equal distance therefrom, and a moving mechanism that moves the head member relative to the medium to be printed upon. The control device includes: a driving signal generating unit that generates a ejecting driving signal, which is a periodic signal having a plurality of pulse waveforms; a driving pulse generating unit that generates a driving pulse string for each unit region of the medium to be printed upon, on the basis of gray-scale data for the unit region, the ejecting driving signal, and information on whether the driving pulse string generated for a previous unit region includes a last pulse waveform or a pulse waveform immediately before the last pulse waveform in one cycle of the ejecting driving signal; and a control unit that drives the pressure changing unit on the basis of the driving pulse. In the control device, the one cycle of the ejecting driving signal corresponds to one unit region of the medium to be printed upon.

According to yet another aspect of the invention, there is provided a control device that controls a liquid-jet apparatus including a head member that has nozzle openings formed therein, a pressure changing unit that changes the pressure of liquid in the nozzle openings to ejecting liquid droplets, a medium holding unit that holds a medium to be ejected upon such that the medium to be ejected upon is arranged opposite to the nozzle openings of the head member and is separated from each of the nozzle openings at a substantially equal distance therefrom, and a moving mechanism that moves the head member relative to the medium to be ejected upon the control device includes: a driving signal generating unit that generates a first ejecting driving signal and a second ejecting driving signal which are periodic signals having different pulse waveforms but having the same cycle; a driving pulse generating unit that generates a driving pulse string for each unit region of the medium to be printed upon, on the basis of gray-scale data for the unit region, the first ejecting driving signal, the second ejecting driving signal, information on whether the driving pulse string generated for a previous unit region includes a last pulse waveform in one cycle of the first ejecting driving signal, and information on whether the driving pulse string generated for a previous unit region includes a last pulse waveform in one cycle of the second ejecting driving signal; and a control unit that drives the pressure changing unit on the basis of the driving pulses. In the control device, the one cycle of each of the ejecting driving signals corresponds to one unit region of the medium to be ejected upon. The last pulse waveform in the one cycle of the first ejecting driving signal is a pulse waveform for ejecting a relatively large amount of liquid droplets, and the last pulse waveform in the one cycle of the second ejecting driving signal is a pulse waveform for ejecting a relatively intermediate amount of liquid droplets. The gray-scale data includes data for a large dot for forming a large dot on the medium to be ejected upon. If the gray-scale data for the unit region is the data for a large dot, at least a first pulse waveform of the driving pulse string generated by the driving pulse generating unit when the driving pulse string generated for the previous unit region includes the last pulse waveform in the one cycle of the second ejecting driving signal, but does not include the last pulse waveform in the one cycle of the first ejecting driving signal is shifted in terms of time to the latter part of at least a first pulse waveform of the driving pulse string generated by the driving pulse generating unit when the driving pulse string generated for the previous unit region does not include either the last pulse waveform in the one cycle of the first ejecting driving signal or the last pulse waveform in the one cycle of the second ejecting driving signal. In addition, at least the first pulse waveform of the driving pulse string generated by the driving pulse generating unit when the driving pulse string generated for the previous unit region includes the last pulse waveform in the one cycle of the first ejecting driving signal, but does not include the last pulse waveform in the one cycle of the second ejecting driving signal is shifted in terms of time to the latter part of at least the first pulse waveform of the driving pulse string generated by the driving pulse generating unit when the driving pulse string generated for the previous unit region includes the last pulse waveform in the one cycle of the second ejecting driving signal, but does not include the last pulse waveform in the one cycle of the first ejecting driving signal.

The control device or the components of the control device can be realized by a computer system.

According to still yet another aspect, there is provided a program that allows a computer system to function as the control device or the components of the control device and a computer readable storage medium having the program stored therein.

The storage medium includes a network for transmitting various signals as well as a medium capable of being recognized as a single matter, such as a floppy disk.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, preferred embodiments of the invention will be described below with reference to the accompanying drawings.

Figure 1:
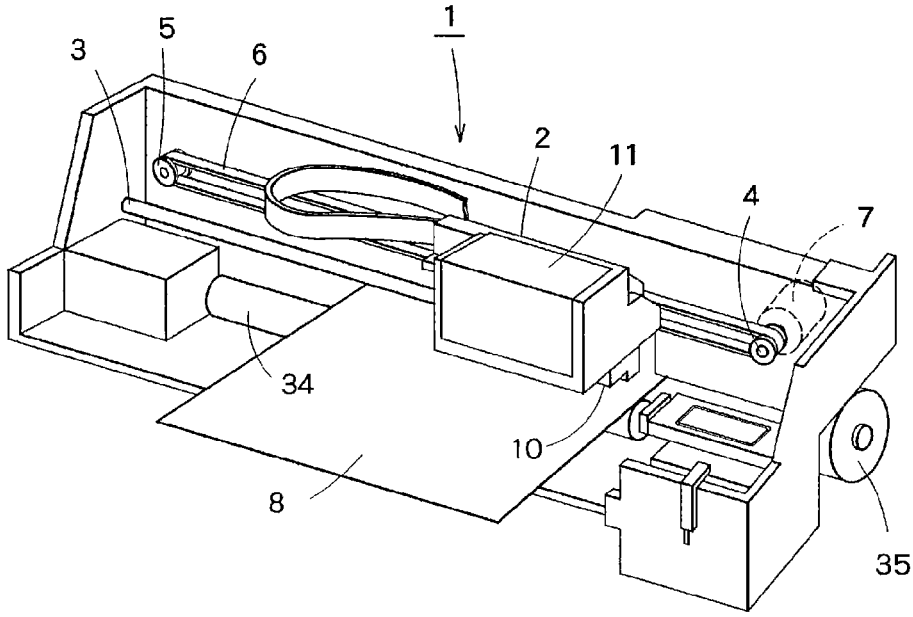
FIG. 1 is a perspective view schematically illustrating an ink-jet printer according to an embodiment of the invention.

FIG. 1 is a perspective view schematically illustrating an ink-jet printer 1, which is a liquid-jet apparatus according to an embodiment of the invention. In the ink-jet printer 1, a carriage 2 is movably mounted to a guide member 3. The carriage 2 is connected to a timing belt 6 that is wounded around a driving pulley 4 and a free pulley 5. The driving pulley 4 is coupled to a rotational shaft of a pulse motor 7. In the above-mentioned structure, the driving of the pulse motor 7 causes the carriage 2 to move in the widthwise direction (scanning direction) of a recording sheet 8.

A recording head 10 (head member) is mounted on a surface (lower surface) of the carriage 2 opposite to the recording sheet 8.

Figure 2:
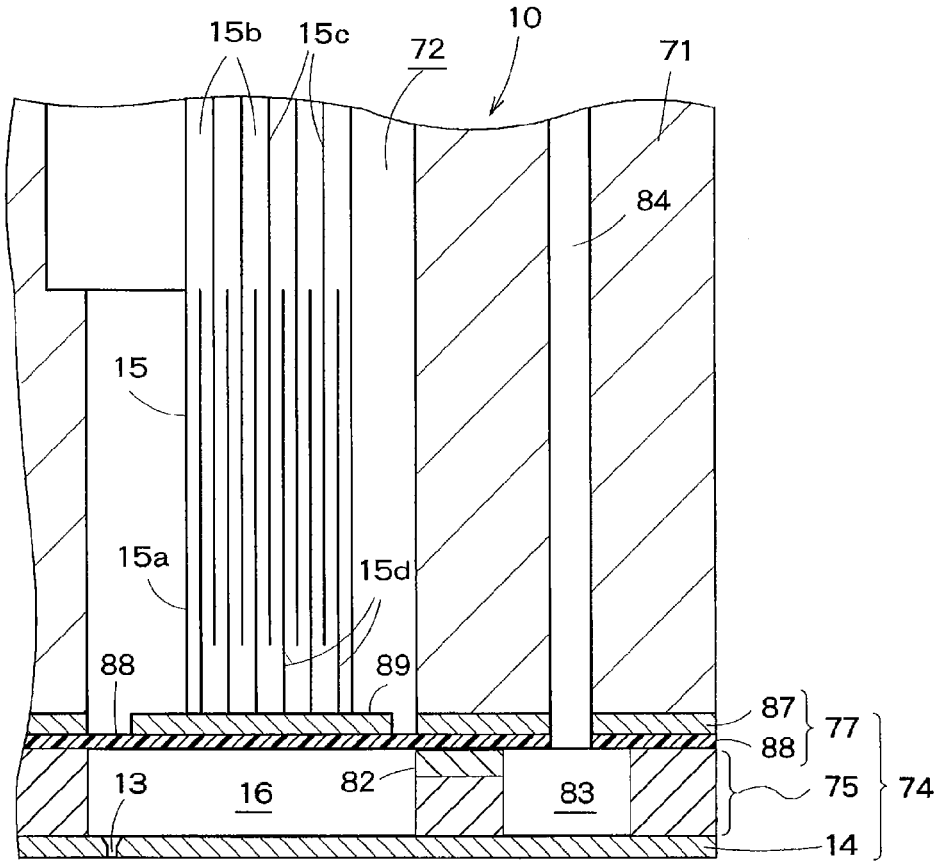
FIG. 2 is a cross-sectional view illustrating the internal structure of a recording head.

As shown in FIG. 2, in the recording head 10, a comb-shaped piezoelectric vibrator 15 is inserted into a storage compartment 72 of a box-shaped case 71 formed of, for example, plastic through one opening thereof, and comb-shaped end portions 15*a* of the piezoelectric vibrator 15 face the other opening. A flow passage unit 74 is bonded to a surface (lower surface) of the case 71 adjacent to the other opening, and the comb-shaped end portions 15*a* abut on and are fixed at predetermined positions on the flow passage unit 74.

The piezoelectric vibrator 15 is formed by cutting a flat vibrator plate, which is obtained by alternately laminating internal electrodes 15*c* and individual internal electrodes 15d on either side of a piezoelectric body 15*b*, in a comb shape so as to correspond to the density of dots to be formed. A difference in potential between the common internal electrode 15*c* and the individual internal electrode 15*d* causes each piezoelectric vibrator 15 to expand in the lengthwise direction of the vibrator orthogonal to the direction in which the electrodes are laminated.

The flow passage unit 74 is formed by arranging a nozzle plate 14 and an elastic plate 77 on either side of a flow passage forming plate 75.

The flow passage forming plate 75 has a plurality of pressure generating chambers 16 that communicate with a plurality of nozzle openings 13 formed in the nozzle plate 14 and are partitioned by the walls of the pressure generating chambers, a plurality of ink supplying portions 82 that communicate with at least one end of each of the pressure generating chambers 16, and a longitudinal common ink chamber 83 that communicates with all the ink supplying chambers 82. For example, the longitudinal common ink chamber 83 is formed by etching, for example, a silicon wafer, and the pressure generating chambers 16 are formed at pitches between the nozzle openings 13 along the longitudinal direction of the common ink chamber 83. The ink supplying portion 82 having a groove shape is formed between each pressure generating chamber 16 and the common ink chamber 83. In this case, the ink supplying portion 82 is connected to one end of the pressure generating chamber 16, and the nozzle opening 13 is formed in the other end of the pressure generating chamber 16 opposite to the ink supplying portion 82. The common ink chamber 83 is a chamber for supplying ink stored in an ink cartridge to the pressure generating chamber 16, and an ink supplying tube 84 communicates with the pressure generating chamber 16 at a substantially central position thereof in the longitudinal direction.

The elastic plate 77 is laminated on a surface of the flow passage forming plate 75 opposite to the nozzle plate 14, and has a laminated structure of a stainless plate 87 and an elastic film 88 formed on the lower surface of the stainless plate 87. The elastic film 88 is formed of a polymer film, such as PPS. A portion of the stainless plate 87 corresponding to the pressure generating chamber 16 is etched to form an island portion 89 for fixing the piezoelectric vibrator 15.

In the recording head 10 having the above-mentioned structure, when the piezoelectric vibrator 15 is expanded in the longitudinal direction thereof, the island portion 89 is pressed against the nozzle plate 14, and thus the elastic film 88 around the island portion 89 is deformed, which causes the pressure generating chamber 16 to be compressed. When the piezoelectric vibrator 15 is contracted in the longitudinal direction in the compressed state of the pressure generating chamber 16, the pressure generating chamber 16 is decompressed by the elasticity of the elastic film 88. When the pressure generating chamber 16 is changed from the decompressed state to the compressed state, the ink pressure of the pressure generating chamber 16 increases, which causes ink to be ejected from the nozzle openings 13.

That is, in the recording head 10, the charging or discharging of the piezoelectric vibrator 15 changes the volume of the corresponding pressure chamber 16. A change in the internal pressure of the pressure chamber 16 makes it is possible to eject ink from the nozzle openings 13 or to minutely vibrate a meniscus (the free surface of ink in the nozzle openings).

A piezoelectric vibrator of a so-called flexural vibration motor may be used instead of the piezoelectric vibrator 15 of the longitudinal vibration motor. The piezoelectric vibrator of the flexural vibration motor is deformed by charging to compress the pressure chamber, and is deformed by discharging to decompress the pressure chamber. When the piezoelectric vibrator of the flexural vibration motor is used, the rising and falling of waveform signals, which will be described later, are opposite to those when the piezoelectric vibrator 15 of the longitudinal vibration motor is used (that is, the polarities of the waveform signals when the piezoelectric vibrator of the flexural vibration motor is used are opposite to those when the piezoelectric vibrator 15 of the longitudinal vibration motor is used).

It is preferable that the recording head 10 be a multi-color recording head capable of recording a plurality of different colors. The multi-color recording head includes a plurality of head units, and the kind of ink used is set for every head unit.

For example, a recording head includes six head units, that is, a black ink head unit capable of ejecting black ink, a cyan ink head unit capable of ejecting cyan ink, a light cyan ink head unit capable of ejecting light cyan ink, a magenta ink head unit capable of ejecting magenta ink, a light magenta ink head unit capable of ejecting light magenta ink, and a yellow ink head unit capable of ejecting yellow ink.

In the ink-jet printer 1 having the above-mentioned structure, the recording head 10 ejects ink as ink droplets during a recording operation in synchronization with the main scanning of the carriage 2. Meanwhile, a platen roller is rotated in operative association with the reciprocation of the carriage 2 to move the recording sheet 8 in a direction in which the sheet is fed (that is, sub-scanning). As a result, for example, images or characters are recorded on the recording sheet 8 on the basis of recording data.

Figure 3:
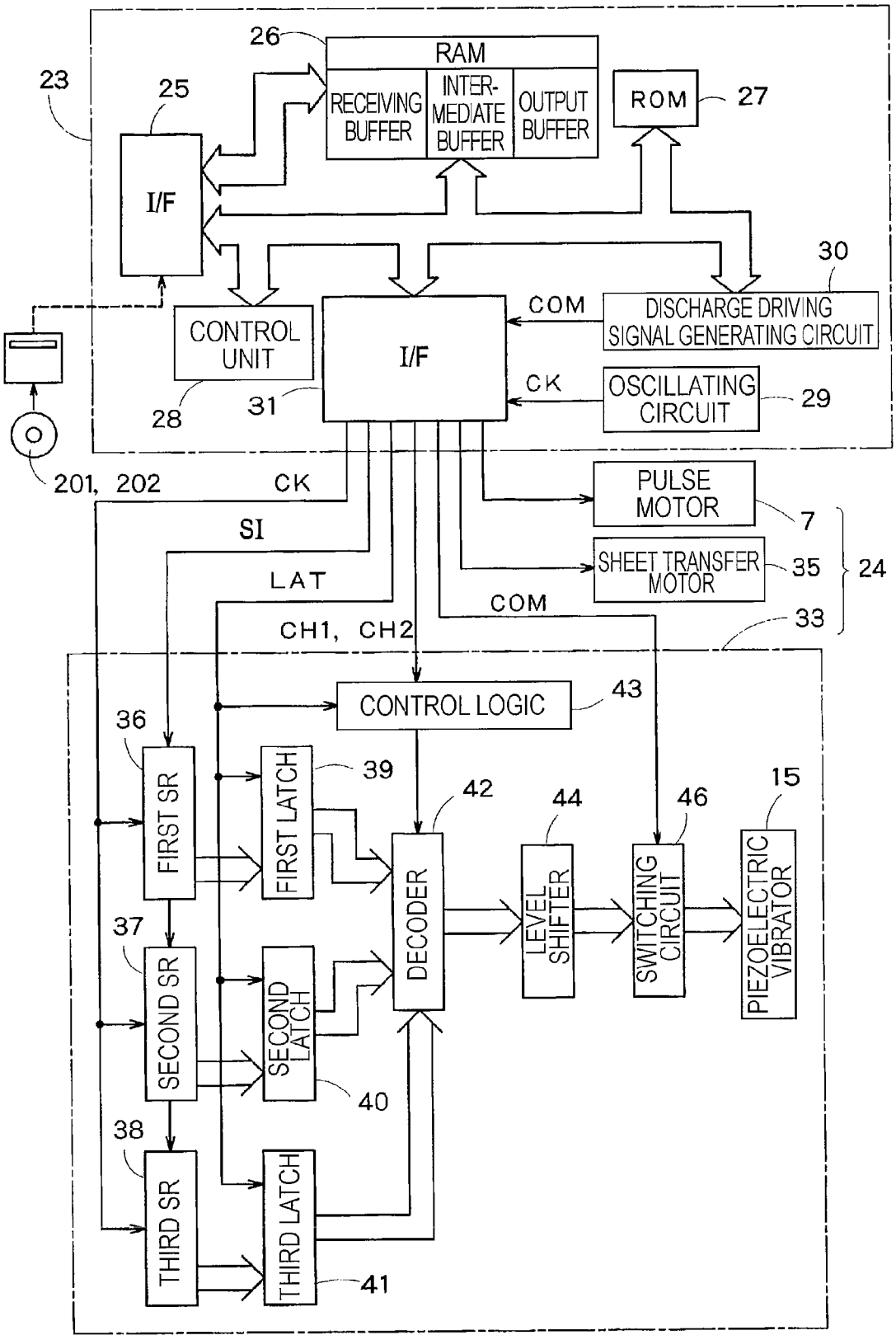
FIG. 3 is a block diagram illustrating the electrical structure of the printer.

Next, the electrical structure of the ink-jet printer will be described below. As shown in FIG. 3, the ink-jet printer 1 includes a printer controller 23 and a printer engine 24.

The printer controller 23 includes an external interface (external I/F) 25, a RAM 26 for temporarily storing various types of data, a ROM 27 for storing, for example, control programs, a control unit 28 including, for example, a CPU, an oscillating circuit 29 for generating a clock signal (CK), a ejecting driving signal generating circuit 30 for generating a ejecting driving signal (COM) to be supplied to the recording head 10, and an internal interface (internal I/F) 31 for transmitting to the printer engine 24 dot pattern data (bitmap data) expanded on the basis of printing data (ejecting data) or a driving signal.

The external I/F 25 receives from a host computer (not shown) printing data composed of, for example, a character code, a graphic function, and image data. A busy signal (BUSY) or an acknowledge signal (ACK) is output to the host computer through the external I/F 25.

The RAM 26 includes a receiving buffer, an intermediate buffer, an output buffer, and a work memory (not shown). The receiving buffer temporarily stores the printing data received through the external I/F 25, and the intermediate buffer stores intermediate code data converted by the control unit 28. The output buffer stores dot pattern data. The dot pattern data is printing data obtained by decoding (decrypting) the intermediate code data.

The ROM 27 stores, for example, control programs (control routines) for executing various data processes, font data, and a graphic function.

The control unit 28 performs various control processes according to the control programs stored in the ROM 27. For example, the control unit 28 reads out the printing data from the receiving buffer, converts the read printing data into intermediate code data, and stores the intermediate code data in the intermediate buffer. In addition, the control unit 28 analyzes the intermediate code data read from the intermediate buffer and expands (decodes) the intermediate code data into dot pattern data on the basis of the graphic function and the font data stored in the ROM 27. Then, the control unit 28 performs necessary additional processes on the dot pattern data and stores the dot pattern data in the output buffer. The dot pattern data is gray-scale data. In this case, the dot pattern data is 3-bit data.

When the dot pattern data corresponding to one line is obtained by the first main scanning of the recording head 10, the dot pattern data corresponding to one line are sequentially output from the output buffer to the recording head 10 through the internal I/F 31. When the dot pattern data corresponding to one line are output from the output buffer, the expanded intermediate code data is removed from the intermediate buffer, and the next intermediate code data is expanded.

The control unit 28 is a portion of a timing signal generating unit, and supplies a latch signal (LAT) or channel signals CH1 and CH2 to the recording head 10 through the internal I/F 31. The latch signal and the channel signals define the supply starting timing of each waveform component of pulse signals forming the ejecting driving signal COM.

Meanwhile, the print engine 24 includes a sheet transfer motor 35, serving as a sheet transfer mechanism, a pulse motor 7, serving as a carriage transfer mechanism, and an electric driving system 33 for the recording head 10. The sheet transfer motor 35 rotates a platen 34 (see FIG. 1) to transfer the recording sheet 8, and the pulse motor 7 drives the timing belt 6 to move the carriage 2.

As shown in FIG. 3, the electric driving system 33 of the recording head 10 includes a shift register circuit having a first shift register 36, a second shift register 37, and a third shift register 38, a latch circuit having a first latch circuit 39, a second latch circuit 40, and a third latch circuit 41, a decoder 42, a control logic 43, a level shifter 44, and a switching circuit 46, and a piezoelectric vibrator 15.

Figure 4:
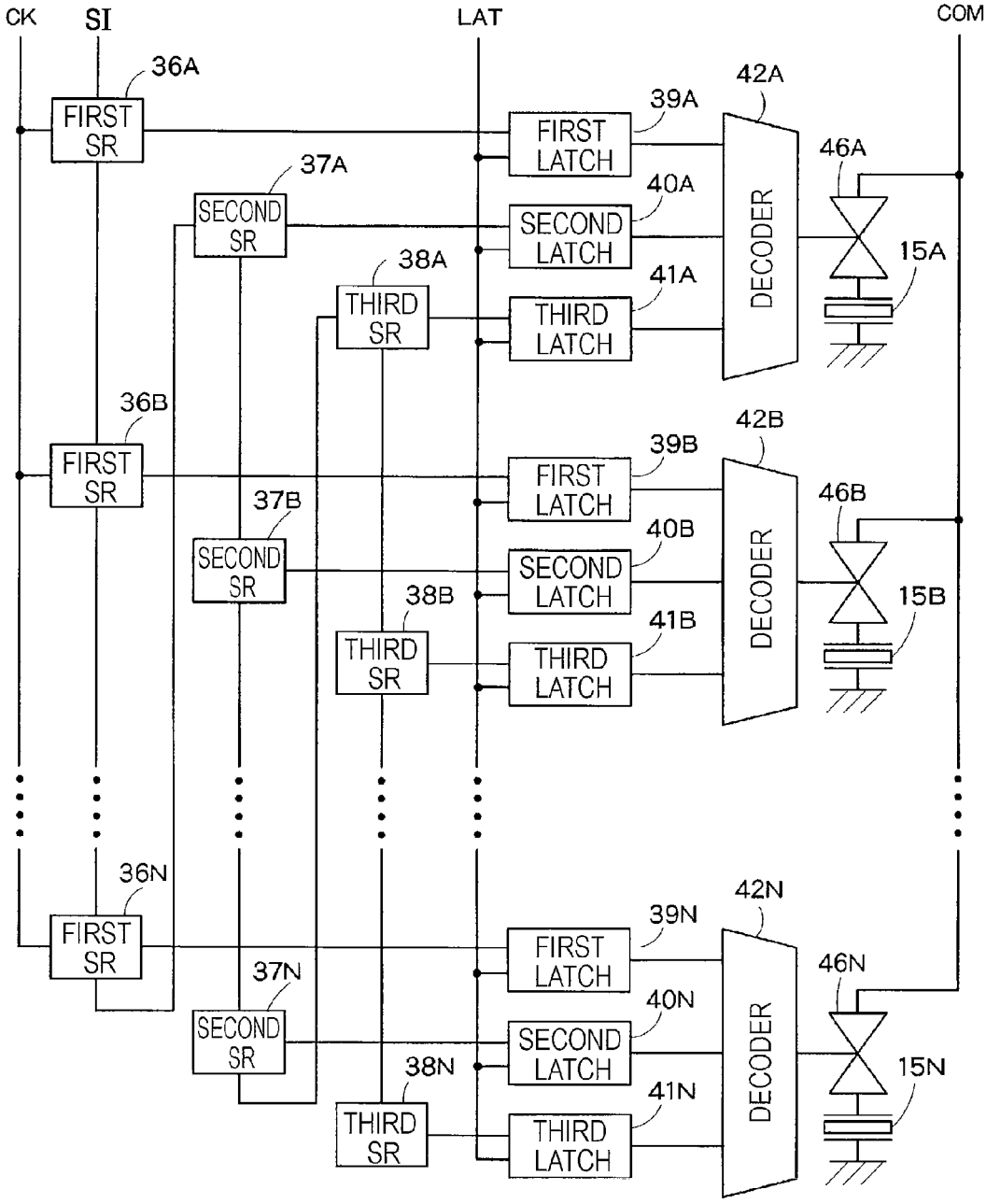
FIG. 4 is a block diagram illustrating an electric driving system of the recording head.

As show in FIG. 4, the first shift register 36 includes first shift registers 36A to 36N. The second shift register 37 includes second shift registers 37A to 37N. The third shift register 38 includes third shift registers 38A to 38N. The first latch circuit 39 includes first latch circuits 39A to 39N. The second latch circuit 40 includes second latch circuits 40A to 40N. The third latch circuit 41 includes third latch circuits 41A to 41N. The decoder 42 includes decoders 42A to 42N. The switching circuit 46 includes switching circuits 46A to 46N. The piezoelectric vibrator 15 includes piezoelectric vibrators 15A to 15N. These components are provided to correspond to the nozzle openings 13 of the recording head 10.

The electric driving system 33 causes the recording head 10 to eject ink on the basis of the gray-scale data from the printer controller 23. The gray-scale data SI from the printer controller 23 is serially transmitted from the internal I/F 31 to the first shift register 36, the second shift register 37, and the third shift register 38 in synchronization with the clock signal CK from the oscillating circuit 29.

As described above, the gray-scale data from the printer controller 23 is 3-bit data. More specifically, in this embodiment, six gray-scale levels including non-recording, the smallest dot, a small dot, an intermediate dot, a large dot, and the largest dot are used. In this case, the non-recording has a binary value of 000, the smallest dot has a binary value of 001, the small dot has a binary value of 100, the intermediate dot has a binary value of 101, the large dot has a binary value of 110, and the largest dot has a binary value of 111.

The gray-scale data is set for every dot, that is, every nozzle opening 13. The most significant bit of the gray-scale data is input to the first shift register 36 (36A to 36N) for all the nozzle openings 13. The intermediate bit data of the 3-bit data is input to the second shift register 37 (37A to 37N) for all the nozzle openings 13. The least significant bit of the gray-scale data is input to the third shift register 38 (38A to 38N) for all the nozzle openings 13.

As shown in FIGS. 3 and 4, the first latch circuit 39 is electrically connected to the first shift register 36. Similarly, the second latch circuit 40 is electrically connected to the second shift register 37. Similarly, the third latch circuit 41 is electrically connected to the third shift register 38. When the latch signal LAT is input from the printer controller 23 to the latch circuits 39 to 41, the first latch 39 latches the least significant bit data of the 3-bit data, the second latch circuit 40 latches the intermediate bit data of the 3-bit data, and the third latch unit 41 latches the most significant bit data of the 3-bit data.

Therefore, a circuit unit including the first shift register 36 and the first latch circuit 39, a circuit unit including the second shift register 37 and the second latch circuit 40, and a circuit unit including the third shift register 38 and the third latch circuit 41 serve as storage circuits. That is, these circuit units temporarily store the previous gray-scale data input to the decoder 42 in the units of 3 bits.

The bit data latched by the latch circuits 39, 40, and 41 are input to the decoders 42A to 42N. The decoder 42 translates 3-bit data (gray-scale data) into pulse selection data (pulse selection information). The pulse selection data is composed of 5-bit data in this embodiment, and each bit corresponds to a waveform component forming the driving signal COM. The supply of the waveform component to the piezoelectric vibrator 15 depends on the content of each bit (for example, a binary value of 0 or 1). The supply of the driving signal COM and the waveform component will be described in detail later.

Meanwhile, a timing signal from the control logic 43 is also input to the decoder 42. The control logic 43 and the control unit 28 serve as a timing signal generating unit for generating a timing signal on the basis of the latch signal LAT and the channel signals CH1, CH2, CH3, CH4, and CH 5.

The pulse selection data translated by the decoder 42 is input to the level shifter 44 from the most significant bit whenever the timing defined by the timing signal occurs. For example, at the first timing of the recording period, the most significant bit data of the pulse selection data is input to the level shifter 44, and at the second timing of the recording period, the second bit data of the pulse selection data is input to the level shifter 44.

The level shifter 44 serves as a voltage amplifier. When the pulse selection data is '1', the level shifter 44 outputs an electric signal having a voltage for driving the switching circuit 46, that is an electric signal having, for example, a voltage of several tens of volts.

The pulse selection data of '1' boosted by the level shifter 44 is supplied to the switching circuit 46 serving as a driving pulse generating unit. The switching circuit 46 selects the waveform component included in the ejecting driving signal COM, on the basis of the pulse selection data generated by the translation of the printing data, generates a driving pulse, and supplies the driving pulse to the piezoelectric vibrator 15. The ejecting driving signal COM is supplied from the ejecting driving signal generating circuit 30 to an input terminal of the switching circuit 46, and the piezoelectric vibrator 15 is connected to an output terminal of the switching circuit 46.

The pulse selection data is used to control the operation of the switching circuit 46. For example, in a period for which the pulse selection data of '1' is supplied to the switching circuit 46, the switching circuit 46 is in an on state, which causes the driving pulse of the ejecting driving signal COM to be supplied to the piezoelectric vibrator 15. As a result, the potential level of the piezoelectric vibrator 15 varies.

Meanwhile, the electric signal for operating the switching circuit 46 is not output from the level shifter 44 in a period for which the pulse selection data of '0' is supplied to the switching circuit 46. Therefore, the switching circuit 46 is in an off state, which causes the driving pulse of the ejecting driving signal not to be supplied to the piezoelectric vibrator 15.

Next, the ejecting driving signal COM generated by the ejecting driving signal generating circuit 30 and a process of controlling the ejecting of ink droplets by the ejecting driving signal will be described in detail below.

Figure 5:
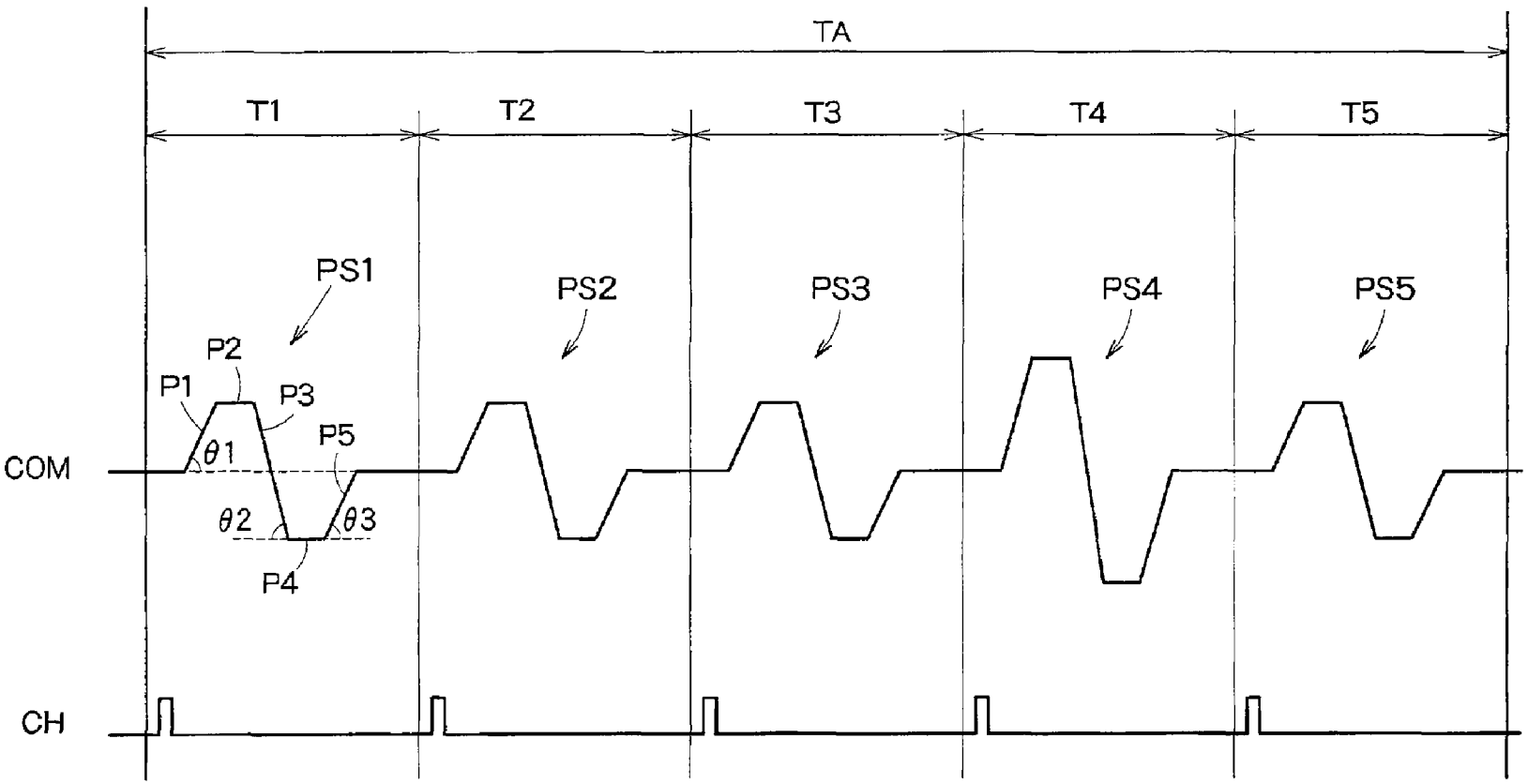
FIG. 5 is a diagram illustrating an example of a driving signal.

The ejecting driving signal COM shown in FIG. 5 is a series of pulse waveform signals obtained by connecting a first pulse waveform signal PS1 in a period T1, a second pulse waveform signal PS2 in a period T2, a third pulse waveform signal PS3 in a period T3, a fourth pulse waveform signal PS4 in a period T4, and a fifth pulse waveform signal PS5 in a period T5. That is, the ejecting driving signal COM is a pulse waveform signal repeatedly generated in a printing cycle TA. In this embodiment, the periods T1, T2, T3 and T5 have the same interval, and are slightly shorter than the period P4.

The first to third pulse waveform signals PS1 to PS3 and the fifth pulse waveform signal PS5 have the same waveform (first pulse waveform), and are used to eject ink droplets of about 5 ng.

More specifically, each of the pulse waveform signals PS1, PS2, PS3, and PS5 includes a first charge component P1 in which potential rises up to a maximum potential VH from an intermediate potential VM at an angle of θ1, a first hold component P2 in which the maximum potential VH is maintained for a short time, a first discharge component P3 in which potential drops from the maximum potential VH to a minimum potential VL at an angle of θ2 in a very short time, a second hold component P4 in which the minimum potential is maintained, and a second charge component P5 in which potential rises up to the intermediate potential VM from the minimum potential VL at an angle of θ3.

When the first charge component P1 is supplied to the piezoelectric vibrator 15 to be charged with the intermediate potential VM, the volume of the pressure generating chamber 16 increases from a reference volume to a maximum volume. Then, the volume of the pressure generating chamber 16 is rapidly decreased to a minimum volume by the first discharge component P3. The compressed state of the pressure generating chamber 16 is maintained during the period for which the second hold component P4 is supplied. The rapid compression and the holding of the compressed state of the pressure generating chamber 16 rapidly raise the internal ink pressure of the pressure generating chamber 16, which causes ink droplets to be ejected from the nozzle openings 13. In this case, the ejecting amount of ink droplets is about 5 ng. The second charge component P5 returns the pressure generating chamber 16 to a decompressed state in order to converge the vibration of the meniscus in a short time.

The fourth pulse waveform signal PS4 has a second pulse waveform different from the first pulse waveform, and is a signal for ejecting an ink droplet of about 7 ng.

More specifically, the fourth pulse waveform signal PS4 includes a first charge component P1' in which potential rises up to a maximum potential VH' from an intermediate potential VM' at an angle of θ1', a first hold component P2' in which the maximum potential VH' is maintained for a short time, a first discharge component P3' in which potential drops from the maximum potential VH' to a minimum potential VL' at an angle of θ2' in a very short time, a second hold component P4' in which the minimum potential is maintained, and a second charge component P5' in which potential rises up to the intermediate potential VM' from the minimum potential VL' at an angle of θ3'.

When the first charge component P1' is supplied to the piezoelectric vibrator 15 to be charged with the intermediate potential VM', the volume of the pressure generating chamber 16 increases from a reference volume to a maximum volume. Then, the volume of the pressure generating chamber 16 is rapidly decreased to a minimum volume by the first discharge component P3'. The compressed state of the pressure generating chamber 16 is maintained during the period for which the second hold component P4' is supplied. The rapid compression and the holding of the compressed state of the pressure generating chamber 16 rapidly raise the internal ink pressure of the pressure generating chamber 16, which causes ink droplets to be ejected from the nozzle openings 13. In this case, the ejecting amount of ink droplets is about 7 ng. The second charge component P5' returns the pressure generating chamber 16 to a decompressed state in order to converge the vibration of the meniscus in a short time.

Figure 6:
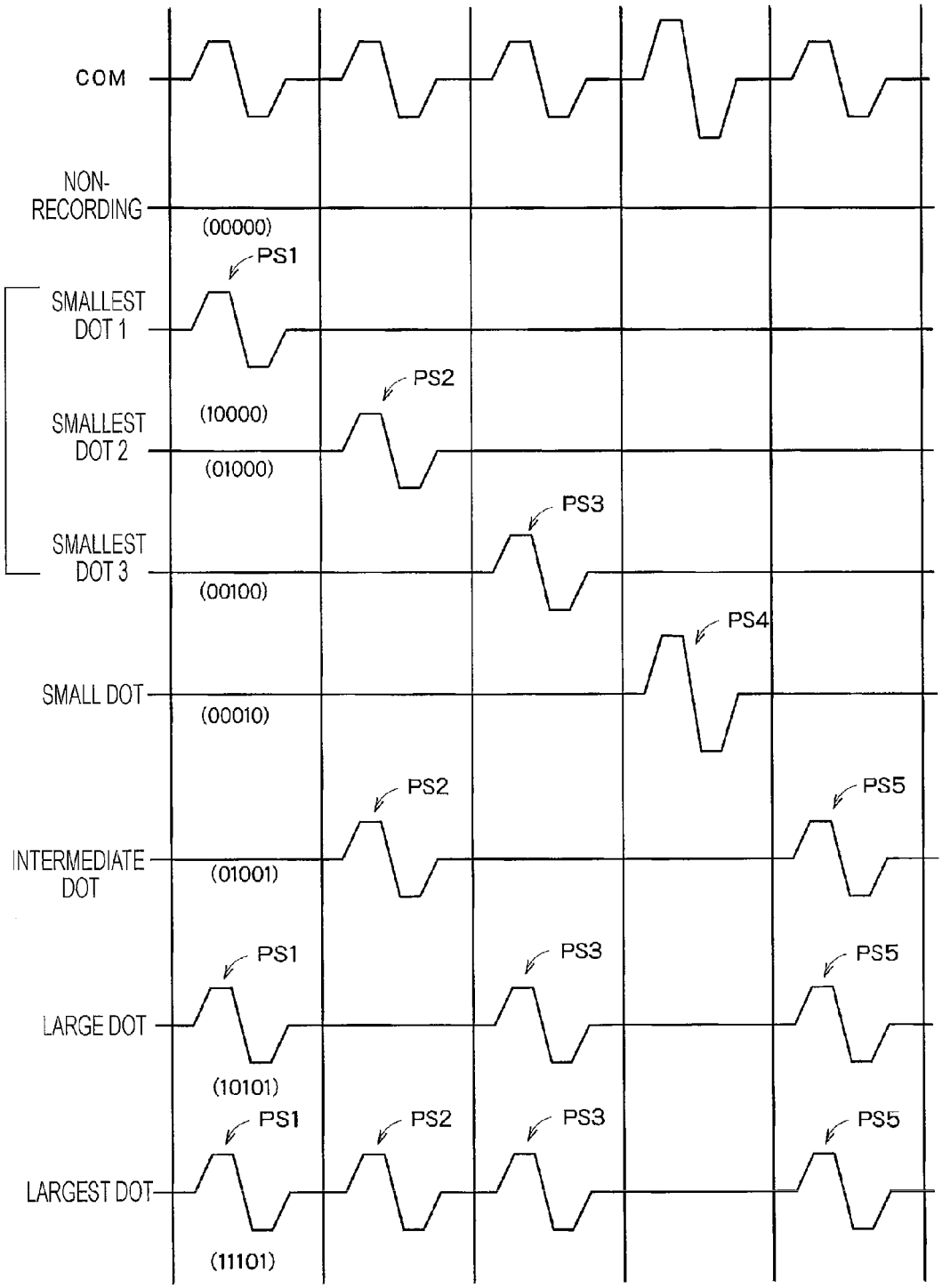
FIG. 6 is a diagram illustrating a driving pulse generated on the basis of the driving signal shown in FIG. 5.

As shown in FIG. 6, it is possible to perform gray-scale control by appropriately selecting the pulse waveform signal supplied to the piezoelectric vibrator 15. That is, no waveform signal is supplied as the driving pulse to realize non-recording. The first pulse waveform signal PS1 is supplied as the driving pulse to record the smallest dot. The fourth pulse waveform signal PS4 is supplied as the driving signal to record a small dot. The second pulse waveform signal PS2 and the fifth pulse waveform signal PS5 are supplied as the driving pulses to record an intermediate dot. The first pulse waveform signal SP1, the third pulse waveform signal PS3, and the fifth pulse waveform signal PS5 are supplied as the driving pulses to record a large dot. The first to third pulse waveform signals PS1 to PS3 and the fifth pulse waveform signal PS5 are supplied as the driving pulses to record the largest dot.

The gray-scale control is performed for the first pixel (unit region) in each row of pixels. For the second pixel and pixels after the second pixel in each row of pixels, the aspect of the gray-scale control varies according to whether a driving pulse string generated for the previous pixel includes the fourth pulse waveform signal PS4 (a second pulse waveform from the last end of one cycle of the ejecting driving signal COM) or the fifth pulse waveform signal PS5 (the last pulse waveform in one cycle of the ejecting driving signal COM).

When the driving pulse string generated for the previous pixel does not include either the fourth pulse waveform signal PS4 or the fifth pulse waveform signal PS5, the same gray-scale control as described above is performed.

When the driving pulse string generated for the previous pixel includes the fifth pulse waveform signal PS5, the aspect of gray-scale control for only the recording of the smallest dot varies. More specifically, gray-scale control is performed such that the second pulse waveform signal PS2 is supplied as the driving pulse to record the smallest dot (the smallest dot 2). As compared with the above-mentioned gray-scale control, the driving pulse (at least the first pulse waveform of the driving pulse string) is shifted to the latter part of at least the first pulse waveform in terms of time.

When the driving pulse string generated for the previous pixel includes the fourth pulse waveform signal PS4, the aspect of gray-scale control for only the recording of the smallest dot varies. More specifically, gray-scale control is performed such that the third pulse waveform signal PS3 is supplied as the driving pulse to record the smallest dot (the smallest dot 3). As compared with the above-mentioned gray-scale control for the smallest dot 2, the driving pulse (at least the first pulse waveform of the driving pulse string) is shifted to the latter part in terms of time.

Next, the pulse selection data generated on the basis of dot pattern data for non-ejecting (non-recording) (gray-scale information '000'), dot pattern data for the smallest dot (gray-scale information '001'), dot pattern data for a small dot (gray-scale information '100'), dot pattern data for an intermediate dot (gray-scale information '101'), dot pattern data for a large dot (gray-scale information '110'), and dot pattern data for the largest dot (gray-scale information '111') will be described in detail below.

The decoder 42 generates 5-bit pulse selection data on the basis of 3-bit data of each dot pattern data. More specifically, in the case in which the driving pulse string generated for the previous pixel does not include either the fourth pulse waveform signal PS4 or the fifth pulse waveform signal PS5, when the dot pattern data is '000', pulse selection data '00000' is generated. When the dot pattern data is '001', pulse selection data '10000' is generated. When the dot pattern data is '100', pulse selection data '00010' is generated. When the dot pattern data is '101', pulse selection data '01001' is generated. When the dot pattern data is '110', pulse selection data '10101' is generated. When the dot pattern data is '111', pulse selection data '11101' is generated.

In the case in which the driving pulse string generated for the previous pixel includes the fifth pulse waveform signal PS5 (the intermediate dot, the large dot, and the largest dot), when the dot pattern data is '000', the pulse selection data '00000' is generated. When the dot pattern data is '001', the pulse selection data '01000' is generated. When the dot pattern data is '100', the pulse selection data '00010' is generated. When the dot pattern data is '101', the pulse selection data '01001' is generated. When the dot pattern data is '110', the pulse selection data '10101' is generated. When the dot pattern data is '111', pulse selection data '11101' is generated.

In the case in which the driving pulse string generated for the previous pixel includes the fifth pulse waveform signal PS5 (the small dot), when the dot pattern data is '000', the pulse selection data '00000' is generated. When the dot pattern data is '001', the pulse selection data '00100' is generated. When the dot pattern data is '100', the pulse selection data '00010' is generated. When the dot pattern data is '101', the pulse selection data '01001' is generated. When the dot pattern data is '110', the pulse selection data '10101' is generated. When the dot pattern data is '111', pulse selection data '11101' is generated.

The most significant bit of the 5-bit pulse selection data corresponds to the first pulse waveform signal SP1, the second bit thereof corresponds to the second pulse waveform signal PS2, the third bit thereof corresponds to the third pulse waveform signal PS3, the fourth bit thereof corresponds to the fourth pulse waveform signal SP4, and the fifth bit thereof corresponds to the fifth pulse waveform signal PS5.

When the most significant bit of the pulse selection data is '1', the switching circuit 46 (driving pulse supplying unit) is in an on state in the period from a first timing signal (latch signal) corresponding to the start point of the period T1 to a second timing signal (CH signal) corresponding to the start point of the period T2. When the second bit of the pulse selection data is '1', the switching circuit 46 is in an on state in the period from the second timing signal to a third timing signal (CH signal) corresponding to the start point of the period T3. Similarly, when the third bit of the pulse selection data is '1', the switching circuit 46 is in an on state in the period from the third timing signal to a fourth timing signal (latch signal) corresponding to the start point of the period T4. When the fourth bit of the pulse selection data is '1', the switching circuit 46 is in an on state in the period from the fourth timing signal to a fifth timing signal (CH signal) corresponding to the start point of the period T5. When the fifth bit of the pulse selection data is '1', the switching circuit 46 is in an on state in the period from the fifth timing signal to a timing signal (latch signal) corresponding to the start point of a period T1 of the next printing cycle TA.

The pulse waveform signal is not supplied to the corresponding piezoelectric vibrator 15 on the basis of the dot pattern data for non-recording. The fourth pulse waveform signal PS4 is supplied on the basis of the dot pattern data for the intermediate dot. The second pulse waveform signal PS2 and the fifth pulse waveform signal PS5 are supplied on the basis of the dot pattern data for the large dot. The first pulse waveform signal PS1, the second pulse waveform signal PS2, the third pulse waveform signal PS3, and the fifth pulse waveform signal PS5 are supplied on the basis of the dot pattern data for the largest dot.

As a result, an ink droplet of about 7 ng is ejected from the nozzle opening 13, corresponding to the dot pattern data for the intermediate dot, and an intermediate dot is formed on the recording sheet 8. An ink droplet of about 5 ng is ejected from the nozzle opening 13 three times, corresponding to the dot pattern data for the large dot, and a large dot is formed on the recording sheet 8. An ink droplet of about 5 ng is ejected from the nozzle opening 13 four times, corresponding to the dot pattern data for the largest dot, and the largest dot is formed on the recording sheet 8.

When the driving pulse string generated for the previous pixel does not include either the fourth pulse waveform signal PS4 or the fifth pulse waveform signal PS5, the first pulse waveform signal PS1 is supplied to the corresponding piezoelectric vibrator 15 on the basis of the dot pattern data for the smallest dot.

When the driving pulse string generated for the previous pixel includes the fifth pulse waveform signal PS5, the second pulse waveform signal PS2 is supplied to the corresponding piezoelectric vibrator 15 on the basis of the dot pattern data for the smallest dot.

When the driving pulse string generated for the previous pixel includes the fourth pulse waveform signal PS4, the third pulse waveform signal PS3 is supplied to the corresponding piezoelectric vibrator 15 on the basis of the dot pattern data for the smallest dot.

As a result, an ink droplet of about 5 ng is ejected from the nozzle opening 13 once, corresponding to the dot pattern data of the smallest dot, and the smallest dot is formed on the recording sheet 8.

In this embodiment of the invention, when the driving pulse string generated for the previous pixel includes the fourth pulse waveform signal PS4 or the fifth pulse waveform signal PS5, the ejecting speed of an ink droplet forming the current pixel may increase due to the residual vibration of the meniscus of ink droplets (which causes the early dropping of ink). Therefore, in this case, as described above, in order to prevent the early dropping of ink, a driving pulse string for the current pixel is shifted to the latter part in terms of time (which delays the early dropping of liquid). More specifically, a different selecting aspect of the driving pulse is applied to the dot pattern data for the smallest dot. In this way, it is possible to generate a driving pulse string considering the residual vibration of the meniscus of ink from the nozzle opening 13 having ejected ink droplets on the basis of the fourth pulse waveform signal PS4 or the fifth pulse waveform signal PS5.

It is considered that the residual vibration of the meniscus of liquid has a larger effect on the ejecting speed of ink droplets as the size of the ink droplet ejected by an ink droplet ejecting operation causing the residual vibration becomes larger. In this embodiment, it is considered that the driving pulse string including the fourth pulse waveform signal PS4 has a larger effect on the residual vibration of the meniscus of ink than the driving pulse string including the fifth pulse waveform signal PS5. Therefore, in this embodiment, when the driving pulse string for the previous pixel includes the fourth pulse waveform signal PS4, the driving pulse string for the current pixel is shifted to the latter part in terms of time, as compared to when the driving pulse string for the previous pixel includes the fifth pulse waveform signal PS5. In this way, it is possible to generate a driving pulse string considering the residual vibration of the meniscus of the nozzle opening 13 having ejected ink droplets.

The ejecting driving signal generating circuit 30 may be formed of a DAC circuit or an analog circuit.

In the above-mentioned structure, the decoding aspect of the decoder 42 varies according to whether the driving pulse string for the previous pixel includes the fourth pulse waveform signal PS4 or the fifth pulse waveform signal PS5. However, the decoding aspect of the decoder 42 corresponding to each gray-scale data may be fixed by changing the gray-scale data according to whether the driving pulse string for the previous pixel includes the fourth pulse waveform signal PS4 or the fifth pulse waveform signal PS5 (for example, when the driving pulse string for the previous pixel includes the fifth pulse waveform signal PS5, the dot pattern data is changed from '001' to '010', and when the driving pulse string for the previous pixel includes the fourth pulse waveform signal PS4, the dot pattern data is changed from '001' to '100').

In this embodiment, it is also possible to changing the order of the fourth pulse waveform signal PS4 and the fifth pulse waveform signal PS5. In this case, it is clear that the driving pulse string including the fourth pulse waveform signal PS4 has a larger effect on the residual vibration of a liquid meniscus than the driving pulse string including the fifth pulse waveform signal PS5. Therefore, similar to the above-mentioned embodiment, when the driving pulse string for the previous pixel includes the fourth pulse waveform signal PS4, the driving pulse string for the current pixel is preferably shifted to the latter part in terms of time, as compared to when the driving pulse string for the previous pixel includes the fifth pulse waveform signal PS5.

Figure 7:
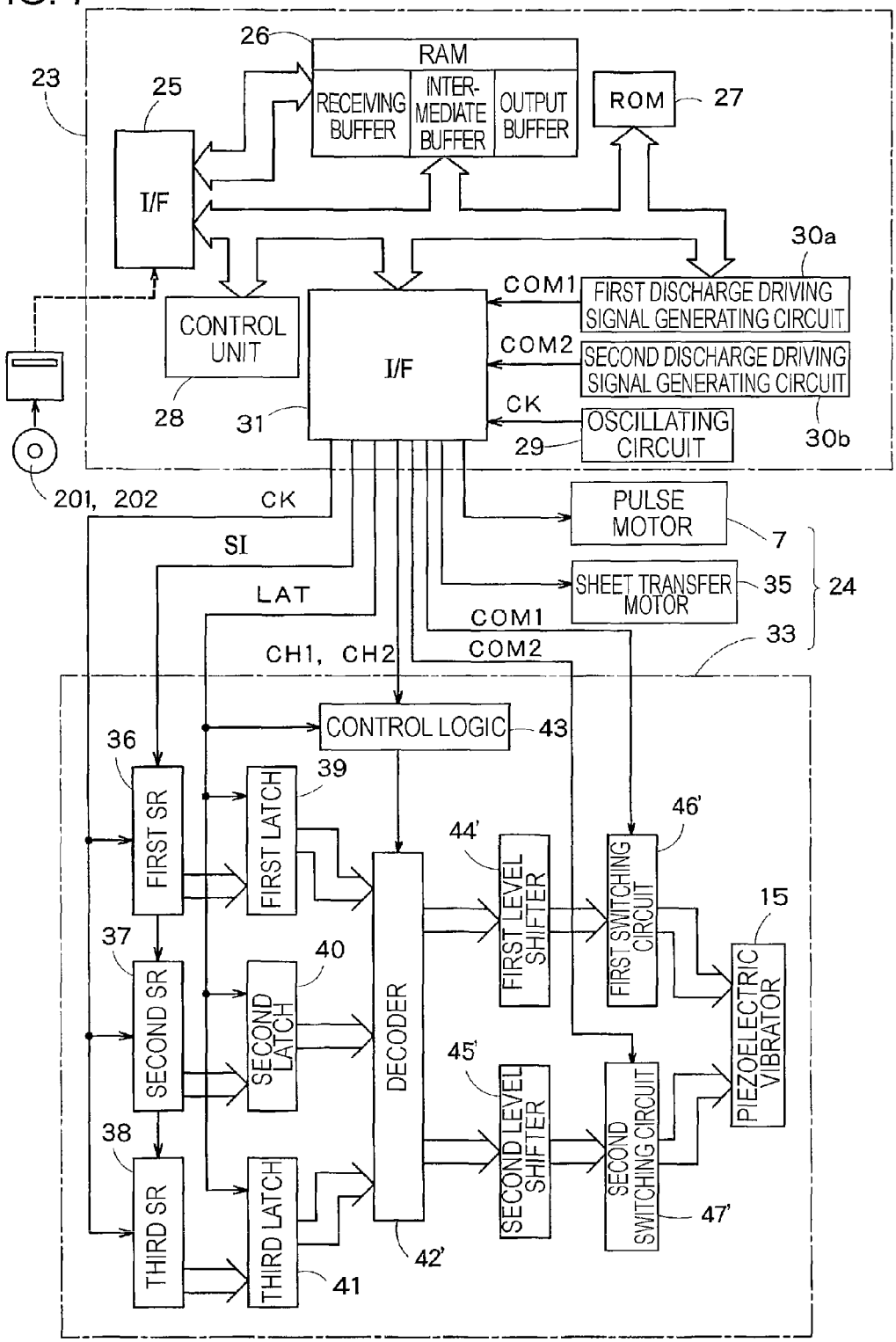
FIG. 7 is a block diagram illustrating the electrical structure of a printer according to a second embodiment of the invention.

Next, a second embodiment of the invention will be described below. As shown in FIG. 7, the second embodiment differs from the first embodiment in that a first ejecting driving signal generating circuit 30*a* for generating a first ejecting driving signal COM1 to be supplied to the recording head 10 and a second ejecting driving signal generating circuit 30*b* for generating a second ejecting driving signal COM2 to be supplied to the recording head 10 are provided instead of the driving signal generating circuit 30.

A decoder 42' translates 3-bit data (gray-scale data) into first pulse selection data and second pulse selection data (pulse selection information). In this embodiment, each of the first pulse selection data and the second pulse selection data is composed of 3-bit data, and each bit corresponds to a waveform component forming the driving signal COM1 or COM2. The supply of the waveform component to the piezoelectric vibrator 15 depends on the content of each bit (for example, a binary value of 0 or 1).

The first pulse selection data translated by the decoder 42' is input to a first level shifter 44' from the most significant bit whenever the timing defined by a timing signal has come. For example, at the first timing of the recording period, the most significant bit data of the first pulse selection data is input to the first level shifter 44', and at the second timing of the recording period, the second bit data of the first pulse selection data is input to the first level shifter 44'.

Similarly, the second pulse selection data translated by the decoder 42' is input to a second level shifter 45' from the most significant bit whenever the timing defined by the timing signal has come. For example, at the first timing of the recording period, the most significant bit data of the second pulse selection data is input to the second level shifter 45', and at the second timing of the recording period, the second bit data of the second pulse selection data is input to the second level shifter 45'.

The first level shifter 44' and the second level shifter 45' serve as voltage amplifiers. When the pulse selection data is '1', the first level shifter 44' and the second level shifter 45' output electric signals having a voltage for driving a first switching circuit 46' and a second switching circuit 47', that is an electric signal having, for example, several tens of voltages, respectively.

The pulse selection data of '1' boosted by the first level shifter 44' is supplied to the first switching circuit 46' serving as a driving pulse generating unit. The first switching circuit 46' selects the waveform component included in the first ejecting driving signal COM1, on the basis of the first pulse selection data generated by the translation of printing data, generates a driving pulse, and supplies the driving pulse to the piezoelectric vibrator 15. The first ejecting driving signal COM1 is supplied from the first ejecting driving signal generating circuit 30*a* to an input terminal of the first switching circuit 46', and the piezoelectric vibrator 15 is connected to an output terminal of the first switching circuit 46'.

The first pulse selection data is used to control the operation of the first switching circuit 46'. For example, in a period for which the pulse selection data of '1' is supplied to the first switching circuit 46', the switching circuit 46' is in an on state, which causes the driving pulse of the first ejecting driving signal COM1 to be supplied to the piezoelectric vibrator 15. As a result, the potential level of the piezoelectric vibrator 15 varies.

Meanwhile, the electric signal for operating the first switching circuit 46' is not output from the first level shifter 44' in a period for which the pulse selection data of '0' is supplied to the first switching circuit 46'. Therefore, the switching circuit 46' is in an off state, which causes the driving pulse of the first ejecting driving signal not to be supplied to the piezoelectric vibrator 15.

The pulse selection data of '1' boosted by the second level shifter 45' is supplied to the second switching circuit 47' serving as a driving pulse generating unit. The second switching circuit 47' selects the waveform component included in the second ejecting driving signal COM2, on the basis of the second pulse selection data generated by the translation of printing data, generates a driving pulse, and supplies the driving pulse to the piezoelectric vibrator 15. The second ejecting driving signal COM2 is supplied from the second ejecting driving signal generating circuit 30*b* to an input terminal of the second switching circuit 47', and the piezoelectric vibrator 15 is connected to an output terminal of the second switching circuit 47'.

The second pulse selection data is used to control the operation of the second switching circuit 47'. For example, in a period for which the pulse selection data of '1' is supplied to the second switching circuit 47', the second switching circuit 47' is in an on state, which causes the driving pulse of the second ejecting driving signal COM2 to be supplied to the piezoelectric vibrator 15. As a result, the potential level of the piezoelectric vibrator 15 varies.

Meanwhile, the electric signal for operating the second switching circuit 47' is not output from the second level shifter 45' in a period for which the pulse selection data of '0' is supplied to the second switching circuit 47'. Therefore, the second switching circuit 47' is in an off state, which causes the driving pulse of the second ejecting driving signal not to be supplied to the piezoelectric vibrator 15.

The structure of the second embodiment is substantially similar to that of the first embodiment, and thus a detailed description thereof will be omitted.

Next, the first ejecting driving signal COM1 generated by the first ejecting driving signal generating circuit 30*a*, the second ejecting driving signal COM2 generated by the second ejecting driving signal generating circuit 30*b*, and a process of controlling the ejecting of ink droplets on the basis of these driving signals will be described in detail below.

Figure 8:
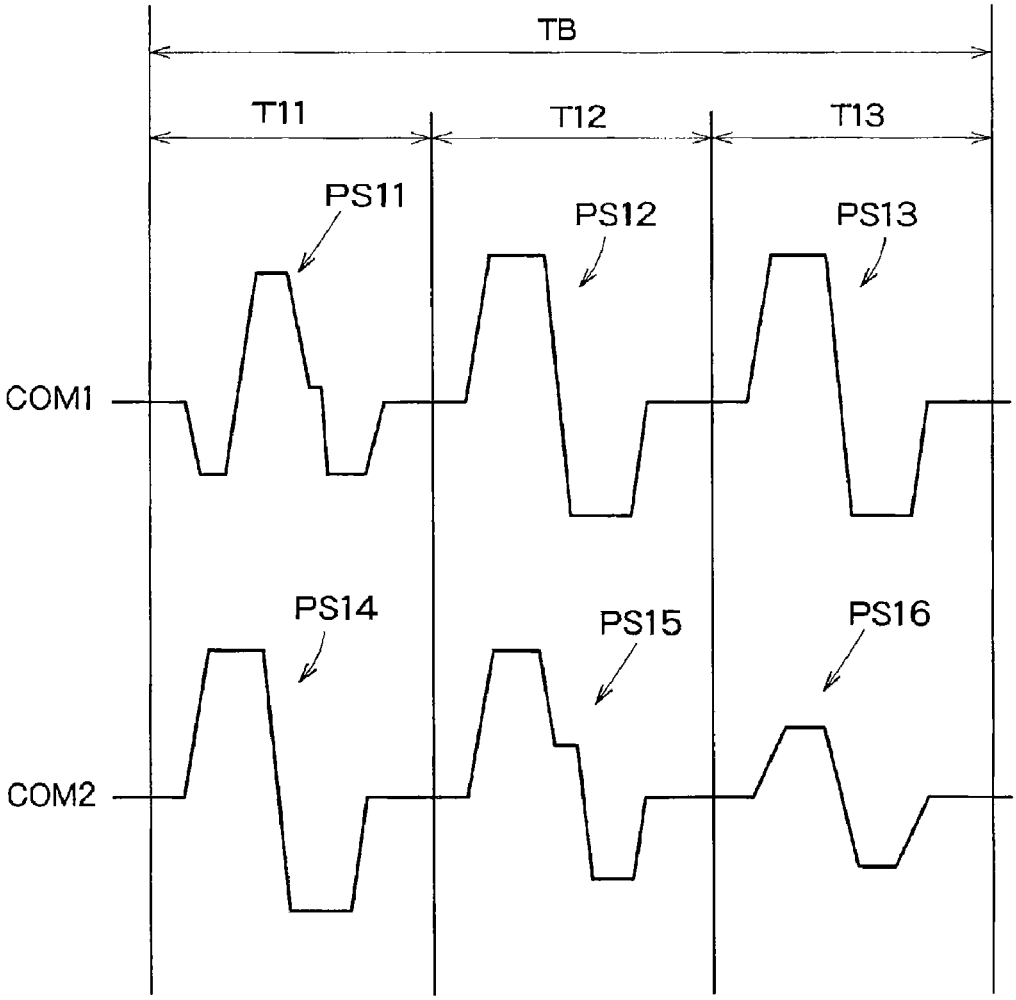
FIG. 8 is a diagram illustrating an example of a plurality of ejecting driving signal COMs.

The first ejecting driving signal COM1 shown in FIG. 8 is a series of pulse waveform signals obtained by connecting a first pulse waveform signal PS11 in a period T11, a second pulse waveform signal PS12 in a period T12, and a third pulse waveform signal PS13 in a period T13. That is, the first ejecting driving signal COM1 is a pulse waveform signal repeatedly generated in a printing cycle TB.

The first pulse waveform signal PS11 is a signal for ejecting a minimum amount of ink droplets (first pulse waveform).

The second pulse waveform signal PS12 and the third pulse waveform signal PS13 have the same waveform, and are signals for ejecting a large amount of ink droplets (second pulse waveform).

The second ejecting driving signal COM2 shown in FIG. 8 is a series of pulse waveform signals obtained by connecting a fourth pulse waveform signal PS14 in the period T11, a fifth pulse waveform signal PS15 in the period T12, and a sixth pulse waveform signal PS16 in the period T13. That is, the second ejecting driving signal COM2 is a pulse waveform signal repeatedly generated in the printing cycle TB.

The fourth pulse waveform signal PS14 is a signal has the same waveform as the second pulse waveform signal PS12 and the third pulse waveform signal PS13 (second pulse waveform).

The fifth pulse waveform signal PS15 is a signal for ejecting a small amount of ink droplets (third pulse waveform).

The sixth pulse waveform signal PS16 is a signal for ejecting an intermediate amount of ink droplets (fourth pulse waveform).

When the pulse waveform signal PS11 is supplied to the piezoelectric vibrator 15, an ink droplet of about 2 pl (the smallest dot) is ejected from the nozzle opening 13.

When the pulse waveform signals PS12, PS13, and PS14 are supplied to the piezoelectric vibrator 15, an ink droplet of about 7 pl (large dot) is ejected from the nozzle opening 13.

When the pulse waveform signal PS15 is supplied to the piezoelectric vibrator 15, an ink droplet of about 3 pl (small dot) is ejected from the nozzle opening 13.

When the pulse waveform signal PS16 is supplied to the piezoelectric vibrator 15, an ink droplet of about 5 pl (intermediate dot) is ejected from the nozzle opening 13.

Figure 9:
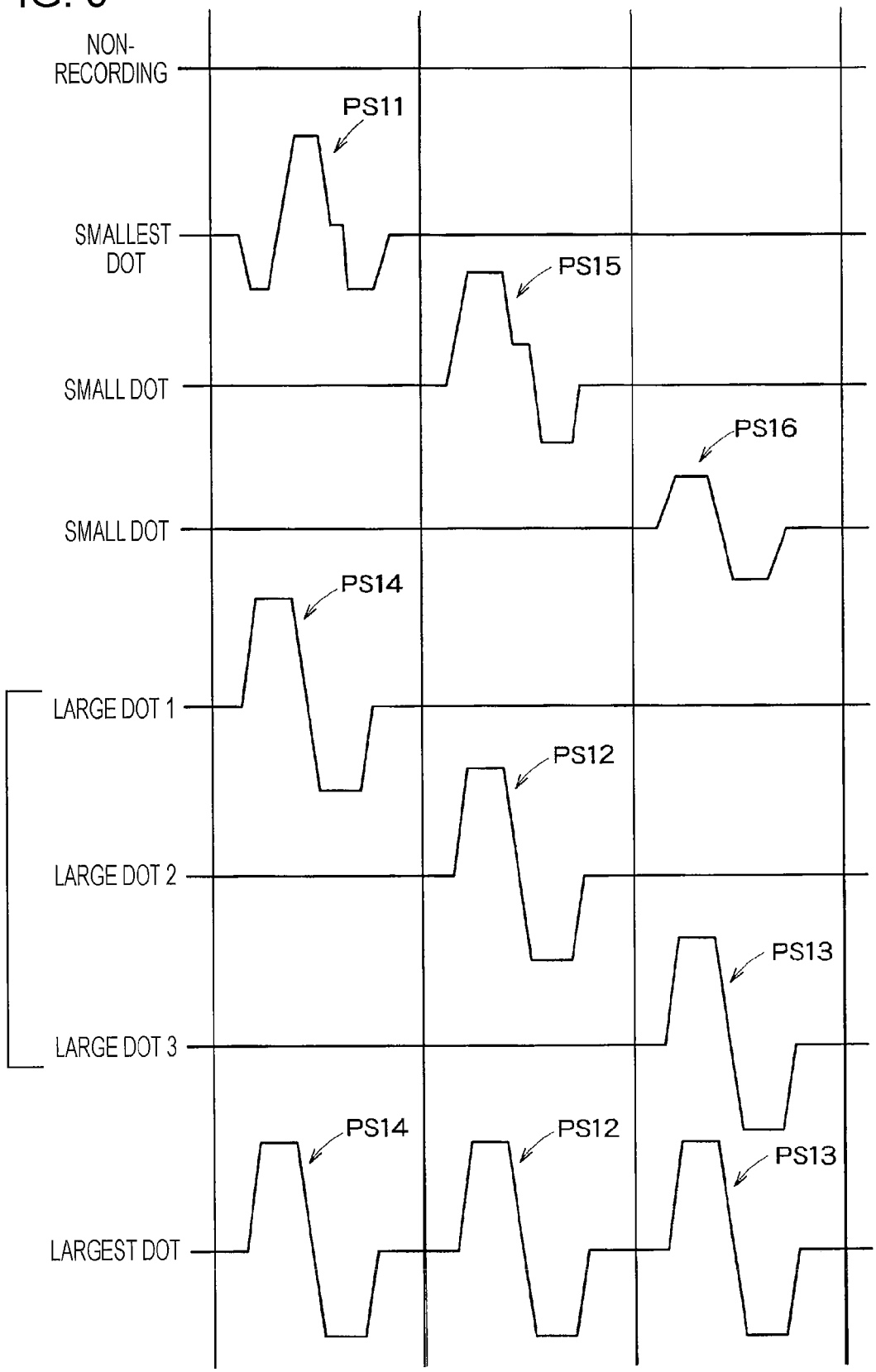
FIG. 9 is a diagram illustrating a driving pulse generated on the basis of the driving signal shown in FIG. 8.
Figure 10:
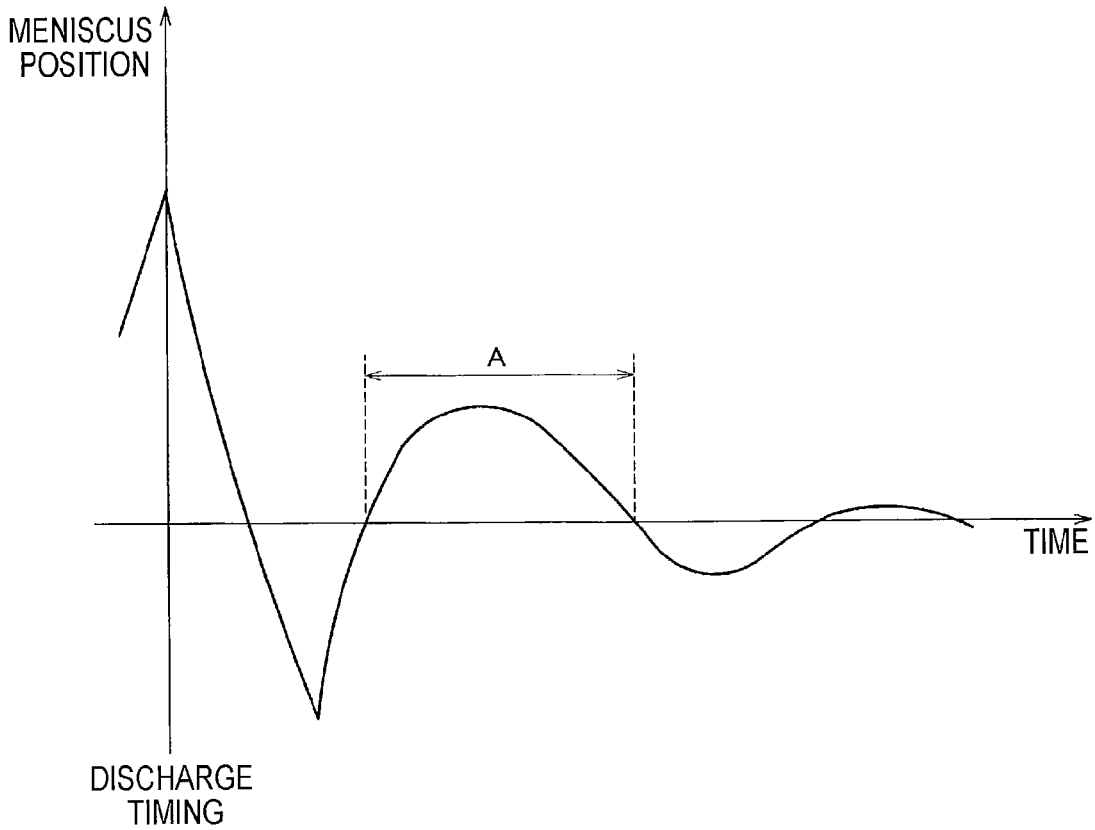
FIG. 10 is a diagram illustrating the state of the residual vibration of an ink meniscus.

As shown in FIG. 9, it is possible to perform gray-scale control by appropriately selecting the pulse waveform signals supplied to the piezoelectric vibrator 15. That is, it is possible to form the smallest dot by supplying the first pulse waveform signal SP11 as the driving pulse. It is possible to form a small dot by supplying the fifth pulse waveform signal SP15 as the driving pulse. It is possible to form an intermediate small dot by supplying the sixth pulse waveform signal SP16 as the driving pulse. It is possible to form a large dot by supplying the fourth pulse waveform signal SP14 as the driving pulse. It is possible to form the largest dot by supplying the second pulse waveform signal SP12, the third pulse waveform signal PS13, and the fourth pulse waveform signal PS14 as the driving pulses.

Next, pulse selection data generated on the basis of dot pattern data for non-ejecting (non-recording) (gray-scale information '000'), dot pattern data for the smallest dot (gray-scale information '001'), dot pattern data for a small dot (gray-scale information '011'), dot pattern data for an intermediate dot (gray-scale information '100'), dot pattern data for a large dot (gray-scale information '110'), and dot pattern data for the largest dot (gray-scale information '111') will be described in detail below.

In this case, the decoder 42' generates first 3-bit pulse selection data and second 3-bit pulse selection data on the basis of 3-bit data of each dot pattern data. More specifically, when the dot pattern data is '000', first pulse selection data '000' and second pulse selection data '000' are generated. When the dot pattern data is '001', first pulse selection data '100' and the second pulse selection data '000' are generated. When the dot pattern data is '010', the first pulse selection data '000' and second pulse selection data '010' are generated. When the dot pattern data is '011', the first pulse selection data '000' and second pulse selection data '001' are generated. When the dot pattern data is '111', first pulse selection data '011' and second pulse selection data '100' are generated.

When the dot pattern data is '100', a decoding aspect depends on whether a driving pulse string generated for the previous pixel includes the third pulse waveform signal PS13 or the sixth pulse waveform signal PS16. That is, when the driving pulse string generated for the previous pixel does not include the third pulse waveform signal PS13 or the sixth pulse waveform signal PS16, the first pulse selection data '000' and the second pulse selection data '100' are generated. When the driving pulse string generated for the previous pixel includes the sixth pulse waveform signal PS16, the first pulse selection data '010' and the second pulse selection data '000' are generated. When the driving pulse string generated for the previous pixel includes the third pulse waveform signal PS13, the first pulse selection data '001' and the second pulse selection data '000' are generated.

The most significant bit of the first 3-bit pulse selection data corresponds to the first pulse waveform signal PS11, the second bit thereof corresponds to the second pulse waveform signal PS12, and the third bit thereof corresponds to the third pulse waveform signal PS13.

The most significant bit of the second 3-bit pulse selection data corresponds to the fourth pulse waveform signal PS14, the second bit thereof corresponds to the fifth pulse waveform signal PS15, and the sixth bit thereof corresponds to the sixth pulse waveform signal PS16.

When the most significant bit of the first pulse selection data is '1', the first switching circuit 46' (driving pulse supplying unit) is in an on state in the period from a first timing signal (latch signal) corresponding to the start point of the period T11 to a second timing signal (CH signal) corresponding to the start point of the period T12. When the second bit of the first pulse selection data is '1', the first switching circuit 46' is in an on state in the period from the second timing signal to a third timing signal (CH signal) corresponding to the start point of the period T13. Similarly, when the third bit of the first pulse selection data is '1', the first switching circuit 46' is in an on state in the period from the third timing signal to a timing signal (latch signal) corresponding to the start point of the period T11 of the next printing cycle TB.

Meanwhile, when the most significant bit of the second pulse selection data is '1', the second switching circuit 47' (driving pulse supplying unit) is in an on state in the period from a first timing signal (latch signal) corresponding to the start point of the period T11 to a second timing signal (CH signal) corresponding to the start point of the period T12. When the second bit of the second pulse selection data is '1', the second switching circuit 47' is in an on state in the period from the second timing signal to a third timing signal (CH signal) corresponding to the start point of the period T13. Similarly, when the third bit of the second pulse selection data is '1', the second switching circuit 47' is in an on state in the period from the third timing signal to a timing signal (latch signal) corresponding to the start point of the period T11 of the next printing cycle TB.

In this way, the pulse waveform signal is not supplied to the corresponding piezoelectric vibrator 15 on the basis of the dot pattern data for non-recording. The first pulse waveform signal PS11 is supplied on the basis of the dot pattern data for the smallest dot. The fifth pulse waveform signal PS15 is supplied on the basis of the dot pattern data for a small dot. The sixth pulse waveform signal PS16 is supplied on the basis of the dot pattern data for an intermediate dot. The second pulse waveform signal PS12, the third pulse waveform signal PS13, and the fourth pulse waveform signal PS14 are supplied on the basis of the dot pattern data for the largest dot.

As a result, an ink droplet of about 2 pl is ejected from the nozzle opening 13 once, corresponding to the dot pattern data for the smallest dot, and the smallest dot is formed on the recording sheet 8. An ink droplet of about 3 pl is ejected from the nozzle opening 13 once, corresponding to the dot pattern data for the small dot, and a small dot is formed on the recording sheet 8. An ink droplet of about 5 pl is ejected from the nozzle opening 13 once, corresponding to the dot pattern data for the intermediate dot, and an intermediate dot is formed on the recording sheet 8. An ink droplet of about 7 pl is ejected from the nozzle opening 13 three times, corresponding to the dot pattern data for the largest dot, and the largest dot is formed on the recording sheet 8.

When the driving pulse string generated for the previous pixel does not include either the third pulse waveform signal PS13 or the sixth pulse waveform signal PS16, the fourth pulse waveform signal PS14 is supplied to the corresponding piezoelectric vibrator 15 on the basis of the dot pattern data for the large dot.

When the driving pulse string generated for the previous pixel includes the sixth pulse waveform signal PS16, the second pulse waveform signal PS12 is supplied to the corresponding piezoelectric vibrator 15 on the basis of the dot pattern data for the large dot.

When the driving pulse string generated for the previous pixel includes the third pulse waveform signal PS13, the third pulse waveform signal PS13 is supplied to the corresponding piezoelectric vibrator 15 on the basis of the dot pattern data for the large dot.

As a result, an ink droplet of about 7 pl is ejected from the nozzle opening 13 once, corresponding to the dot pattern data of the large dot, and a large dot is formed on the recording sheet 8.

In this embodiment of the invention, when the driving pulse string generated for the previous pixel includes the third pulse waveform signal PS13 or the sixth pulse waveform signal PS16, the ejecting speed of an ink droplet forming the current pixel may increase due to the residual vibration of the meniscus of the ink droplet. Therefore, in this case, as described above, in order to prevent the increase in the ejecting speed, a driving pulse string for the current pixel is shifted to the latter part in terms of time (including at least the first pulse waveform of the driving pulse string). More specifically, a different selecting aspect of the driving pulse is applied to the dot pattern data for the large dot. In this way, it is possible to generate a driving pulse string considering the residual vibration of the meniscus of ink from the nozzle opening 13 having ejected ink droplets on the basis of the third pulse waveform signal PS13 or the sixth pulse waveform signal PS16.

It is considered that the residual vibration of the meniscus of ink has a larger effect on the ejecting speed of ink droplets as the size of the ink droplet ejected by an ink droplet ejecting operation causing the residual vibration becomes larger. In this embodiment, it is considered that the driving pulse string including the third pulse waveform signal PS13 has a larger effect on the residual variation of the meniscus of ink than the driving pulse string including the sixth pulse waveform signal PS16. Therefore, in this embodiment, when the driving pulse string for the previous pixel includes the third pulse waveform signal PS13, the driving pulse string for the current pixel is shifted to the latter part in terms of time, as compared to when the driving pulse string for the previous pixel includes the sixth pulse waveform signal PS16. In this way, it is possible to generate a driving pulse string considering the residual vibration of the meniscus of ink from the nozzle opening 13 having ejected ink droplets.

In FIG. 8, the first ejecting driving signal COM1 and the second ejecting driving signal COM2 are periodic signals each having three pulses in one period. However, the first and second ejecting driving signals COM1 and COM2 may be periodic signals each having four or more pulses in one period.

The first ejecting driving signal generating circuit 30*a* and the second ejecting driving signal generating circuit 30*b* may be formed of DAC circuit or analog circuits.

In the above-mentioned structure, the decoding aspect of the decoder 42' varies according to whether the driving pulse string for the previous pixel includes the third pulse waveform signal PS13 or the sixth pulse waveform signal PS16. However, the decoding aspect of the decoder 42' corresponding to each gray-scale data may be fixed by changing the gray-scale data according to whether the driving pulse string for the previous pixel includes the third pulse waveform signal PS13 or the sixth pulse waveform signal PS16 (for example, when the driving pulse string for the previous pixel includes the sixth pulse waveform signal PS16, the dot pattern data is changed from '100' to '101', and when the driving pulse string for the previous pixel includes the third pulse waveform signal PS13, the dot pattern data is changed from '100' to '110').

In the above-described embodiments, the pressure changing unit is formed of the piezoelectric vibrator 15, but the pressure changing unit for changing the pressure of the pressure chamber 16 is not limited to the piezoelectric vibrator 15. For example, a magnetostrictive element may be used as the pressure generating element to compress or decompress the pressure chamber 16, thereby changing the pressure of the pressure chamber 16. Alternatively, a heater element may be used as the pressure generating element. In this case, the pressure of the pressure chamber 16 is changed by air bubbles that are contracted or expanded by heat generated by the heater element.

As described above, the printer controller 23 is formed of a computer system, but the invention is not limited thereto. The invention can also be applied to a program for allowing the computer system to execute the above-mentioned components and a computer readable storage medium 201 having the program stored therein.

When the above-mentioned components are realized by a program operated in the computer system, such as an operating system, the invention can also applied to a program including various commands for controlling the operating system and a storage medium 202 having the program stored therein.

The storage media 201 and 202 include a network for transmitting various signals as well as a medium capable of being recognized as a single matter, such as a floppy disk (flexible disk).

Although the ink-jet recording apparatus has been described above, the invention can be applied to all types of liquid-jet apparatuses. For example, any of the following materials can be used as liquid: ink; glue; manicure; a liquid electrode material; and a bioorganic material. The invention can also be applied to an apparatus for manufacturing color filters of a display unit, such as a liquid crystal display device.

What is claimed is:

1. A liquid-jet-apparatus comprising:

a driving signal generating unit that generates a ejecting driving signal, which is a periodic signal having a plurality of pulse waveforms;

a driving pulse generating unit that generates a driving pulse string for each unit region of a medium to be printed upon, on the basis of gray-scale data for the unit region, the ejecting driving signal, and information on whether the driving pulse string generated for a previous unit region includes a last pulse waveform or a pulse waveform immediately before the last pulse waveform in one cycle of the ejecting driving signal; and a control unit that drives a pressure changing unit on the basis of the driving pulse, wherein the one cycle of the ejecting driving signal corresponds to one unit region of the medium to be printed upon, wherein the gray-scale data includes data for a small dot for forming a small dot on the medium to be printed upon, and if the gray-scale data for the unit region is the data for a small dot, at least a first pulse waveform of the driving pulse string generated by the driving pulse generating unit when the driving pulse string generated for the previous unit region includes the last pulse waveform or the pulse waveform immediately before the last pulse waveform in the one cycle of the ejecting driving signal is shifted in terms of time to the latter part of at least a first pulse waveform of the driving pulse string generated by the driving pulse generating unit when the driving pulse string generated for the previous unit region does not include either the last pulse waveform or the pulse waveform immediately before the last pulse waveform in the one cycle of the ejecting driving signal.

2. The liquid-jet apparatus according to claim 1, wherein the last pulse waveform in the one cycle of the ejecting driving signal is a pulse waveform for ejecting a relatively small amount of liquid droplets, the pulse waveform immediately before the last pulse waveform in the one cycle of the ejecting driving signal is a pulse waveform for ejecting a relatively intermediate amount of liquid droplets, if the gray-scale data for the unit region is the data for a small dot, at least the first pulse waveform of the driving pulse string generated by the driving pulse generating unit when the driving pulse string generated for the previous unit region includes the last pulse waveform, but does not include the pulse waveform immediately before the last pulse waveform in the one cycle of the ejecting driving signal is shifted in terms of time to the latter part of at least the first pulse waveform of the driving pulse string generated by the driving pulse generating unit when the driving pulse string generated for the previous unit region does not include either the last pulse waveform or the pulse waveform immediately before the last pulse waveform in the one cycle of the ejecting driving signal, and at least the first pulse waveform of the driving pulse string generated by the driving pulse generating unit when the driving pulse string generated for the previous unit region includes the pulse waveform immediately before the last pulse waveform in the one cycle of the ejecting driving signal is shifted in terms of time to the latter part of at least the first pulse waveform of the driving pulse string generated by the driving pulse generating unit when the driving pulse string generated for the previous unit region does not include the pulse waveform immediately before the last pulse waveform, but includes the last pulse waveform in the one cycle of the ejecting driving signal.

3. The liquid-jet apparatus according to claim 2, wherein the ejecting driving signal is a periodic signal having four first pulse waveforms and a second waveform in one cycle, the four first pulse waveforms are arranged in first to third periods and a fifth period in the one cycle, and the second pulse waveform is arranged in a fourth period, the first pulse waveform is a pulse waveform for ejecting a relatively small amount of liquid droplets, and the second pulse waveform is a pulse waveform for ejecting a relatively intermediate amount of liquid droplets.

4. The liquid-jet apparatus according to claim 3, wherein, if the gray-scale data for the unit region is the data for a small dot, the driving pulse string generated by the driving pulse generating unit when the driving pulse string generated for the previous unit region does not include the second pulse waveform in the fourth period of the one cycle of the ejecting driving signal, but includes the first pulse waveform in the fifth period is a driving pulse string including the first pulse waveform in the second period of the one cycle, the driving pulse string generated by the driving pulse generating unit when the driving pulse string generated for the previous unit region includes the second pulse waveform in the fourth period of the one cycle of the ejecting driving signal is a driving pulse string including the first pulse waveform in the third period of the one cycle, and the driving pulse string generated by the driving pulse generating unit when the driving pulse string generated for the previous unit region does not include either the first pulse waveform in the fifth period of the one cycle of the ejecting driving signal or the second pulse waveform in the fourth period thereof is a driving pulse string including the first pulse waveform in the first period of the one cycle.

5. The liquid-jet apparatus according to claim 1, wherein the last pulse waveform in the one cycle of the ejecting driving signal is a pulse waveform for ejecting a relatively intermediate amount of liquid droplets, the pulse waveform immediately before the last pulse waveform in the one cycle of the ejecting driving signal is a pulse waveform for ejecting a relatively small amount of liquid droplets, if the gray-scale data for the unit region is the data for a small dot, at least the first pulse waveform of the driving pulse string generated by the driving pulse generating unit when the driving pulse string generated for the previous unit region does not include the last pulse waveform, but includes the pulse waveform immediately before the last pulse waveform in the one cycle of the ejecting driving signal is shifted in terms of time to the latter part of at least the first pulse waveform of the driving pulse string generated by the driving pulse generating unit when the driving pulse string generated for the previous unit region does not include either the last pulse waveform or the pulse waveform immediately before the last pulse waveform in the one cycle of the ejecting driving signal, and at least the first pulse waveform of the driving pulse string generated by the driving pulse generating unit when the driving pulse string generated for the previous unit region includes the last pulse waveform in the one cycle of the ejecting driving signal is shifted in terms of time to the latter part of at least the first pulse waveform of the driving pulse string generated by the driving pulse generating unit when the driving pulse string generated for the previous unit region does not include the last pulse waveform, but includes the pulse waveform immediately before the last pulse waveform in the one cycle of the ejecting driving signal.

6. A liquid-jet apparatus comprising:

a driving signal generating unit that generates a first ejecting driving signal and a second ejecting driving signal which are periodic signals having different pulse waveforms but having the same cycle;

a driving pulse generating unit that generates a driving pulse string for each unit region of a medium to be printed upon, on the basis of gray-scale data for the unit region, the first ejecting driving signal, the second ejecting driving signal, information on whether the driving pulse string generated for a previous unit region includes a last pulse waveform in one cycle of the first ejecting driving signal, and information on whether the driving pulse string generated for a previous unit region includes a last pulse waveform in one cycle of the second ejecting driving signal; and a control unit that drives the pressure changing unit on the basis of the driving pulses, wherein the one cycle of the ejecting driving signals corresponds to one unit region of the medium to be printed upon, the last pulse waveform in the one cycle of the first ejecting driving signal is a pulse waveform for ejecting a relatively large amount of liquid droplets, the last pulse waveform in the one cycle of the second ejecting driving signal is a pulse waveform for ejecting a relatively intermediate amount of liquid droplets, the gray-scale data includes data for a large dot for forming a large dot on the medium to be printed upon, if the gray-scale data for the unit region is the data for a large dot, at least a first pulse waveform of the driving pulse string generated by the driving pulse generating unit when the driving pulse string generated for the previous unit region includes the last pulse waveform in the one cycle of the second ejecting driving signal, but does not include the last pulse waveform in the one cycle of the first ejecting driving signal is shifted in terms of time to the latter part of at least a first pulse waveform of the driving pulse string generated by the driving pulse generating unit when the driving pulse string generated for the previous unit region does not include either the last pulse waveform in the one cycle of the first ejecting driving signal or the last pulse waveform in the one cycle of the second ejecting driving signal, and at least the first pulse waveform of the driving pulse string generated by the driving pulse generating unit when the driving pulse string generated for the previous unit region includes the last pulse waveform in the one cycle of the first ejecting driving signal, but does not include the last pulse waveform in the one cycle of the second ejecting driving signal is shifted in terms of time to the latter part of at least the first pulse waveform of the driving pulse string generated by the driving pulse generating unit when the driving pulse string generated for the previous unit region includes the last pulse waveform in the one cycle of the second ejecting driving signal, but does not include the last pulse waveform in the one cycle of the first ejecting driving signal.

7. The liquid-jet apparatus according to claim 6, wherein the first ejecting driving signal is a periodic signal having a first pulse waveform and two second pulse waveforms arranged in this order in the one cycle, the second ejecting driving signal is a periodic signal having the second pulse waveform, a third pulse waveform, and a fourth pulse waveform arranged in this order in the one cycle, the first pulse waveform is a pulse waveform for ejecting a smallest amount of liquid droplets, the second pulse waveform is a pulse waveform for ejecting a relatively large amount of liquid droplets, the third pulse waveform is a pulse waveform for ejecting a relatively small amount of liquid droplets, and the fourth pulse waveform is a pulse waveform for ejecting a relatively intermediate amount of liquid droplets.

* * * * *